US006158788A

United States Patent [19]

Ikeda et al.

[11] Patent Number: 6,158,788

[45] Date of Patent: Dec. 12, 2000

[54] DOOR LOCKING DEVICE

[75] Inventors: Ichio Ikeda; Hideaki Fukaya, both of Nagoya, Japan

[73] Assignee: Kabushikikaisha Ansei, Japan

[21] Appl. No.: 09/202,067

[22] PCT Filed: Sep. 26, 1997

[86] PCT No.: PCT/JP97/03451

§ 371 Date: Dec. 8, 1998

§ 102(e) Date: Dec. 8, 1998

[87] PCT Pub. No.: WO98/29628

PCT Pub. Date: Jul. 9, 1998

[30] Foreign Application Priority Data

Dec. 27, 1996 [JP] Japan ..... 8-359207

[51] Int. Cl.[7] ..... E05C 3/06; E05C 3/16

[52] U.S. Cl. ..... 292/216; 292/DIG. 63; 292/336.3

[58] Field of Search ..... 292/216, DIG. 23, 292/DIG. 25, 225, 28, 50, DIG. 63, DIG. 31, 336.3

[56] References Cited

U.S. PATENT DOCUMENTS

| | | | |
|---|---|---|---|
| 4,342,209 | 8/1982 | Kleefeldt | 70/264 |
| 4,889,373 | 12/1989 | Ward et al. | 292/336.3 |
| 5,005,885 | 4/1991 | Kobayashi et al. | 292/336.3 |
| 5,853,060 | 12/1998 | Chao et al. | 180/69.2 |
| 5,927,775 | 7/1999 | Trammell, Jr. | 292/348 |

FOREIGN PATENT DOCUMENTS 169644 1/1986 European Pat. Off. .

*Primary Examiner*—Lynne H. Browne
*Assistant Examiner*—John B. Walsh
*Attorney, Agent, or Firm*—William A. Drucker

[57] ABSTRACT

In a lock device in which a lock device main unit is operated from an operating handle via a single interlinking cable, provisions are made so that the releasing operation of the lock device main unit by the operating handle can be accomplished with a small force, and also that switching from a locked condition to an unlocked condition can be made reliably. An operating member for performing the locking, unlocking, and releasing operations and a switching member for performing switching between the locked and unlocked conditions are interlocked by using an interlocking member provided on the switching member and a guide portion and releasing portion provided on the operating member. The interlocking relationship between them is such that when the operating member moves between the unlocked position and the locked position, the guide portion causes the interlocking member to move, thereby switching the switching member between the unlocked condition and the locked condition, and when the operating member moves between the unlocked position and the released position, the interlocking member is engaged in the releasing portion, thereby cutting off the transmission of force from the operating member to the switching member.

3 Claims, 18 Drawing Sheets

DOOR LOCKING DEVICE

TECHNICAL FIELD

The present invention relates to a door lock device for a vehicle door, and in particular to a door lock device operable into three conditions: first, a condition in which the door is held in a closed position (a closed position holding condition), second, a condition in which the door is locked in the closed position (a locked condition), and third, a condition in which the holding of the closed position is released (a released condition).

BACKGROUND ART

Generally, in this type of door lock device, a lock device main unit B having the above three operating modes is mounted on an open/close free end side D1 of a door D in FIG. 1. In a prior art example, a knob for effecting the operation from the closed position holding condition to the locked condition and vice versa and a lever for effecting the operation from the closed position holding condition to the released condition are mounted on the interior side of the door, the knob and lever being connected with the lock device main unit by individual rods for transmitting the knob movement and lever movement, respectively, to the lock device main unit B.

Such a door lock device has had the various problems described below because the rods are non-elastic rigid members. There are at least four problems.

A stick or the like is inserted between the door body and the door window from outside the vehicle so that the rods are operated to put the lock device into the released condition and thus open the door, and articles inside the vehicle are stolen.

When the vehicle collides, there is a possibility that the rods may be mechanically bent and the lock device main unit may be put into the same condition as if the rods are pulled, that is, into the released condition, causing the door to open and thus exposing passengers to danger.

If the prescribed route along which the rods are to be installed in the vehicle door is bent, it is difficult to install the rods along the prescribed route when assembling the lock device onto the door, and the assembling work efficiency is impaired.

Assembling the lock device to the door demands close dimensional tolerances on the positional relationship between the lock device main unit and the knob and lever, and the assembling work has to be done with care, which requires a lot of time and work.

To solve the above-enumerated problems, there is proposed the following construction. That is, an operating member for effecting the operation to switch between the closed position holding condition, lock condition, and released condition is provided in the lock device main unit, the operating member being made switchable between three positions, i.e., an unlocked position, a locked position, and a released position. In the main unit, an engaging member for engaging a latch member that engages on a striker is interlocked with the operation of the operating member such that when the operating member is in the released position, engagement of the latch member by the engaging member is released, and when the operating member is in any of the other positions, the latch is engaged with the engaging member. Further, a locking lever for switching the door lock device between the unlocked and locked conditions is interlocked with the operation of the operating member such that when the operating member is in the locked position, the locking lever is in the locked condition, and when the operating member is in any of the other positions, the locking lever is in the unlocked condition. On the other hand, an operating handle for switching the mode between the closed position holding condition, locked condition, and released condition is mounted on the interior side of the door. This operating handle is connected with the operating member in the lock device main unit by a flexible cable. Such a construction is proposed (for example, in European Patent Application No. 169644).

In the above construction, since the cable for connecting the lock device main unit with the operating handle in interlocking relationship is flexible, the cable cannot be operated with a stick or the like from outside the vehicle, thus providing excellent security against theft. Furthermore, since the cable, if bent in the event of a vehicle collision, does not cause the operating member in the lock device main unit to switch from one position to another, there is no danger of accidental switching into the released condition, and safety can thus be secured for vehicle passengers. Moreover, when assembling the lock device to the door, since the cable can be installed by being bent freely, the assembly work is easy, and since the assembling does not demand strict positional relationship between the lock device main unit and the operating member, the assembling work can be done without special care. Further, although the cable which has the various advantages described above is expensive, the above construction requires only one such cable and the cost increase associated with the use of the cable, therefore, is reduced, which, coupled with the fact that only one cable is necessary and with the resulting reduction in the number of steps in cable assembling work, offers the effect of being able to implement the construction at a relatively low cost.

In the above-constructed door lock device, the interlocking operation between the operating member and locking lever in the lock device main unit is accomplished by the construction shown in FIG. 27. That is, the locking lever 161 pivotably mounted on a housing 160 has two flanges 162 and 163. The operating member 166, which is constructed to be movable forward and backward by an inner wire 165 of the interlinking cable 164, has a disc 167 at one portion thereof, and the disc 167 is located between the two flanges 162 and 163. Between the flange 162 and the disc 167 is interposed a coil spring 168 which urges the disc 167 toward the flange 163 with respect to the locking lever 161. The member indicated at 169 in the operating member 166 is an interlocking portion for interlocking with the engaging member.

In the above construction, with the locking lever 161 staying in the unlocked condition (the closed position holding condition) shown by the solid line, when the wire 165 is pushed downward in the figure to switch to the locked mode (the locked condition), the flange 163 is pushed by the disc 167, which causes the locking lever 161 to move to the position indicated by the two-dot chain line and thus into the locked condition. In the locked condition, when the wire 165 is pulled in the opposite direction, the flange 162 is pushed by the disc 167 via the spring 168, thus returning the locking lever to the unlocked condition.

In the unlocked condition, when the wire 165 is further pulled to effect switching to the released condition, the locking lever 161 is not displaced but the spring 168 is only compressed by the disc 167, and the engagement with the engaging member is released by the movement of the interlocking portion 169.

The above construction has had the problem that a force equal to the sum of the force needed to release the engagement with the engaging member and the force needed to compress the spring 168 has to be applied at the operating handle in order to effect the switching to the released condition, thus increasing the operating force of the operating handle.

On the other hand, if the force of the spring 168 is reduced to lessen the operating force, there arises the problem that when the movement of the locking lever 161 becomes heavy because of freezing or rusting due to aging, even if the operating handle is operated to effect unlocking from the locked condition the locking lever 161 remains fixed in the position indicated by the two-dot chain line while the spring 168 is being compressed, making it impossible to effect release from the locked condition.

Using only one handle to control the three operations, i.e., the operations between the locked position, unlocked position, and released position, is very convenient. But, sometimes, there are cases where while the vehicle is slowing down and is coming to a stop, the passenger pulls the handle successively until accidentally putting it into the released position when he just intends to operate the handle from the locked position to the unlocked position. If this happens, there is a danger that the vehicle door may be opened while the vehicle is slowing down.

The door lock device of the present invention is provided to solve the above-described problems associated with the prior art, and an object of the invention is to provide a door lock device capable of effecting the operation to switch between the three modes, i.e., the closed position holding condition, the locked condition, and the released condition.

Another object of the invention is to permit the connection between the operating handle and the lock device main unit by a cable, ensures the prevention of theft and the safety in the event of a collision, and facilitate assembling to the door.

A further object of the invention is to enable the construction using only one cable to be implemented at a relatively low cost.

A further object of the invention is to enable the operation from the unlocked condition to the released condition to be effected with a relatively light operating force, without using a spring as in the prior art, in the construction using one cable to accomplish the operation of the three modes.

A further object of the invention is to ensure reliable switching from the locked condition to the unlocked condition by the operation of the operating handle, without using a spring as in the prior art, even when the member for effecting the switching between the unlocked condition and the locked condition becomes difficult to move because of freezing or rusting due to aging.

Still another object of the invention is to enable the operation from the unlocked position to the released position to be made different from the operation from the locked position to the unlocked position, if necessary, in a construction that allows the three mode operations between the locked position, unlocked position, and released position to be carried out using only one handle.

Other objects and advantages of the present invention will become more apparent from the accompanying drawings and the following description given in conjunction with the drawings.

DISCLOSURE OF THE INVENTION

To accomplish the above objects, a door lock device of the present invention comprising: a rotatable latch member (2) mounted on a base frame (1) and having an engaging portion (36) for engaging a striker (39); an engaging member (3), mounted on the base frame (1), for engaging the latch member (2); and an operating member (4) mounted on the base frame (1), and linked with an operating part (C) by a cable (7) and made switchable between three positions, an unlocked position, a locked position, and a released position, by operation of one operating handle (13) in the operating part in order to place the engaging member (3) in an unlocked condition, a locked condition, and a released condition, respectively, the operating member (4) being interlocked with the engaging member (3) so that when the operating member (4) is in the released position, the latch member (2) is disengaged from the engaging member (3), and when the operating member (4) is in any of the other positions, the latch member (2) is engaged with the engaging member (3); the door lock device characterized in that: the interlocking construction of the operating member (4) and the engaging member (3) is such that a switching means (6) is provided that is movable back and forth between an unlocked position facing a portion of the engaging member (3) and a locked position for maintaining the locked condition of the engaging member (3), the switching means (6) having an interlocking member (91) for interlocking with the operating member (4), while the operating member (4) has a guide portion (63) for switching the switching means (6) between the unlocked position and the locked position by moving the interlocking member (91) when the operating member (4) moves between the unlocked position and the locked position, and a releasing portion (64) so formed as to cut off the interlocking with the interlocking member (91) when the operating member (4) moves between the unlocked position and the released position.

BEST MODE FOR CARRYING OUT THE INVENTION

Figure 1:
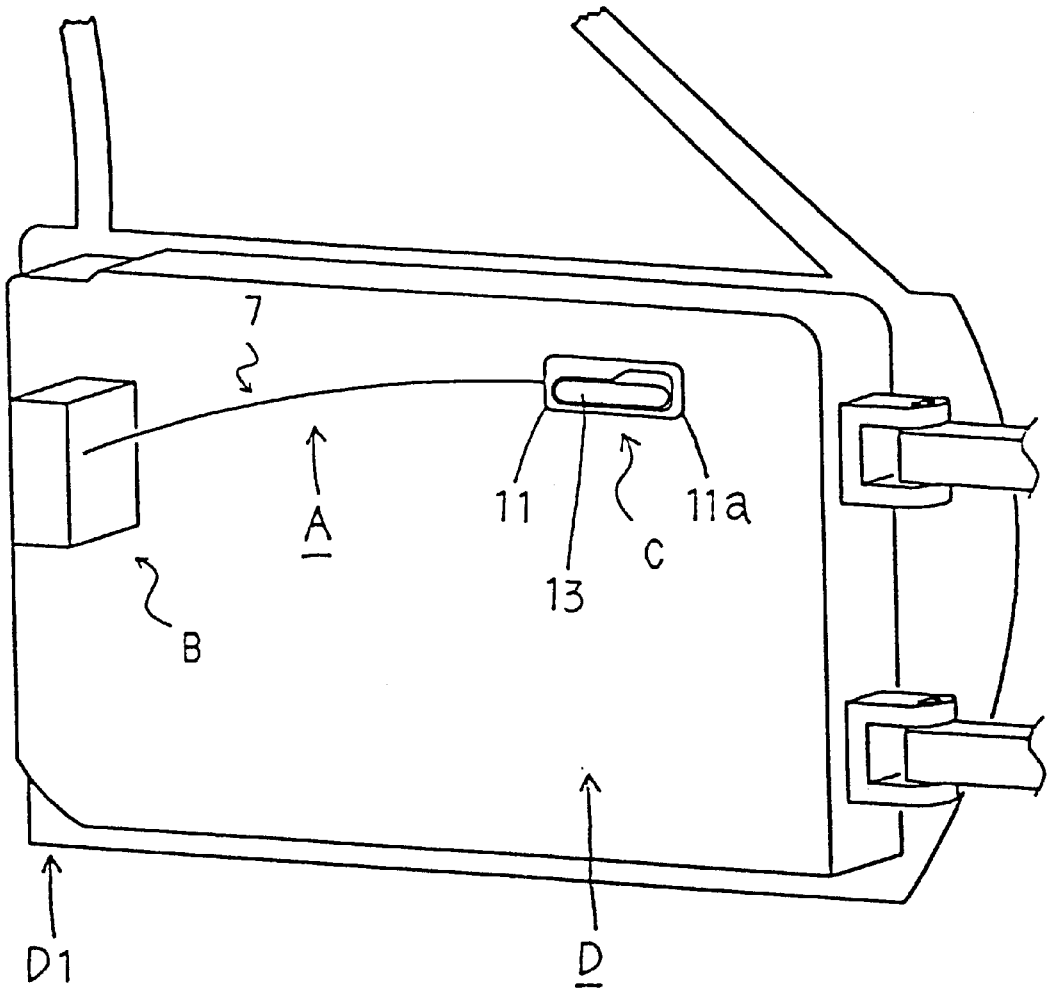
FIG. 1 is a partially cutaway view in perspective showing the interior side of a door.
Figure 2:
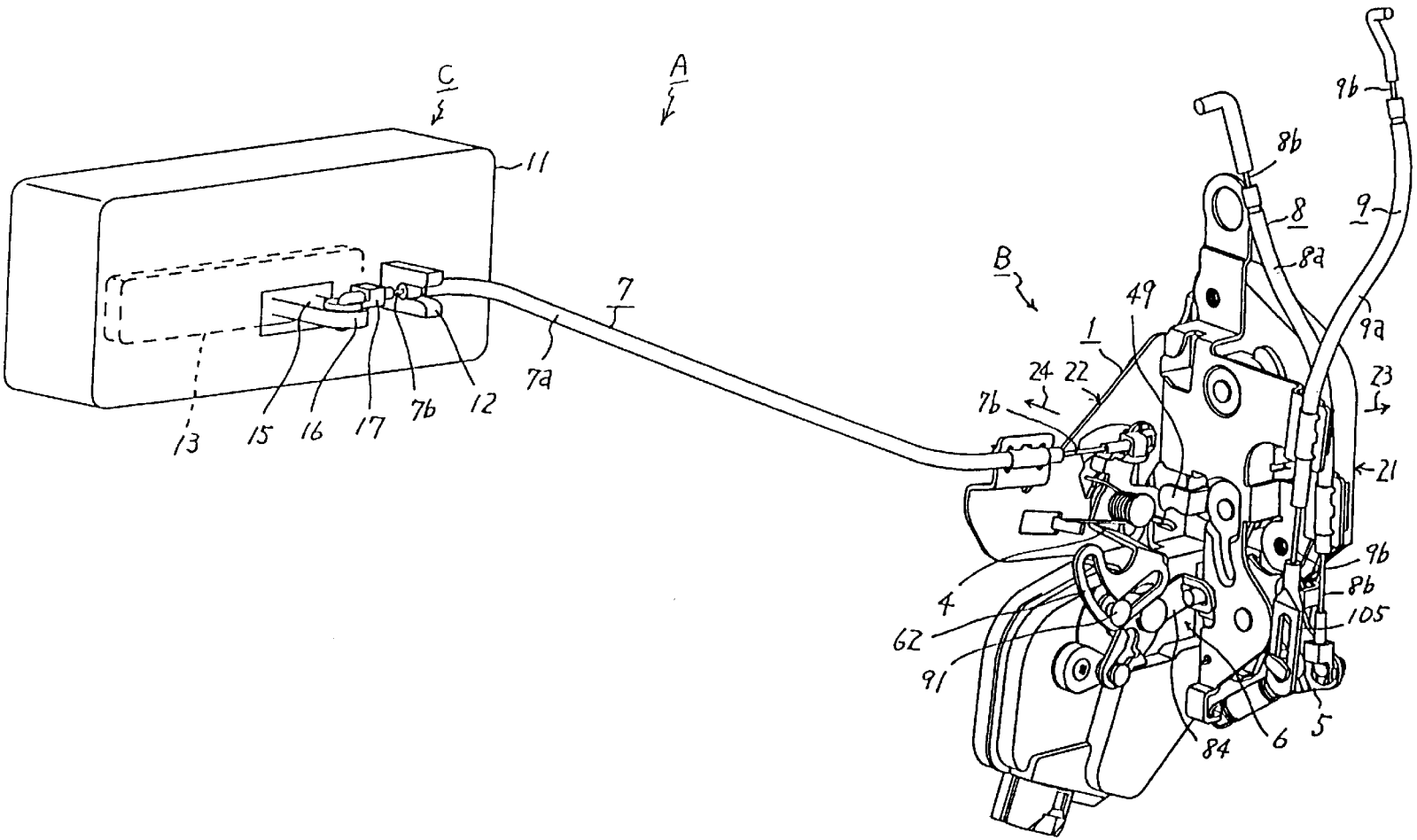
FIG. 2 is a perspective view of a door lock device.

The mode for carrying out the present invention will be described below with reference to drawings. In FIGS. 1 and 2 showing a door lock device in its entirely, the door lock device A comprises a lock device main unit B mounted on a free end side D1 of a vehicle door D and an operating part C mounted on the interior side of the door. Other components includes an operating part for releasing, usually mounted on the exterior side of the door D, and an operating part for locking and unlocking, which is operated by a key. Further, reference numeral 7 indicates a cable for connecting the lock device main unit B with the operating part C so that the former can be operated from the latter, 8 designates a cable for connecting the lock device main unit B with the release operating part on the door exterior so that the former can be operated from the latter, and 9 denotes a cable for connecting the lock device main unit B with the key-operated lock and unlock operating part so that the former can be operated from the latter. These cables are of the type capable of transmitting pushing and pulling forces, and comprise, for example, flexible wires 7*b*, 8*b*, and 9*b* slidably housed inside flexible sheathes 7*a*, 8*a*, and 9*a* respectively, as is well known in the art.

First, the operating part C will be described with reference to FIGS. 2 to 5. Reference numeral 11 is a frame which serves as a base for mounting various members in the operating part C, and which is mounted with its upper side in FIGS. 3 to 5 facing the interior side of the door. Reference numeral 12 is a fastening portion for the sheath 7*a* of the cable 7; the fastening portion is formed integrally with the frame 11. Reference numeral 13 is an operating handle which is operated by hand for locking, unlocking, and releasing operations, and whose pivoting portion 14 is pivotably mounted on the frame 11. Reference numeral 15 is an arm for transmitting the operating force of the handle to the wire 7*b* of the cable 7; the arm is provided with a wire fastening portion 16 at its end.

Reference numeral 17 is a fastener for fastening the end of the wire 7*b* to the fastening portion 16.

Figure 6:
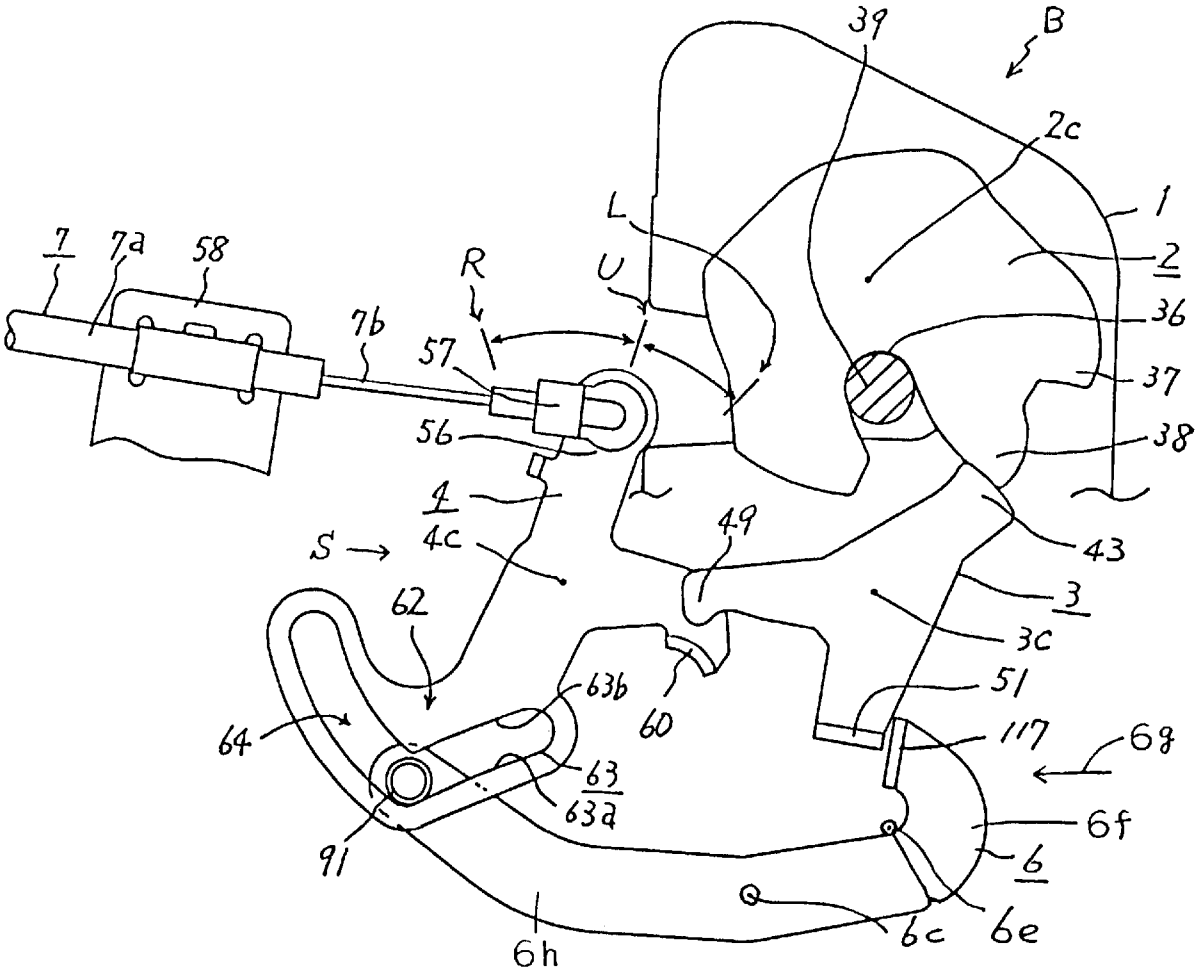
FIG. 6 is a diagram showing the construction concerning the basic principle of a lock device main unit, the main unit being shown in an unlocked condition.
Figure 7:
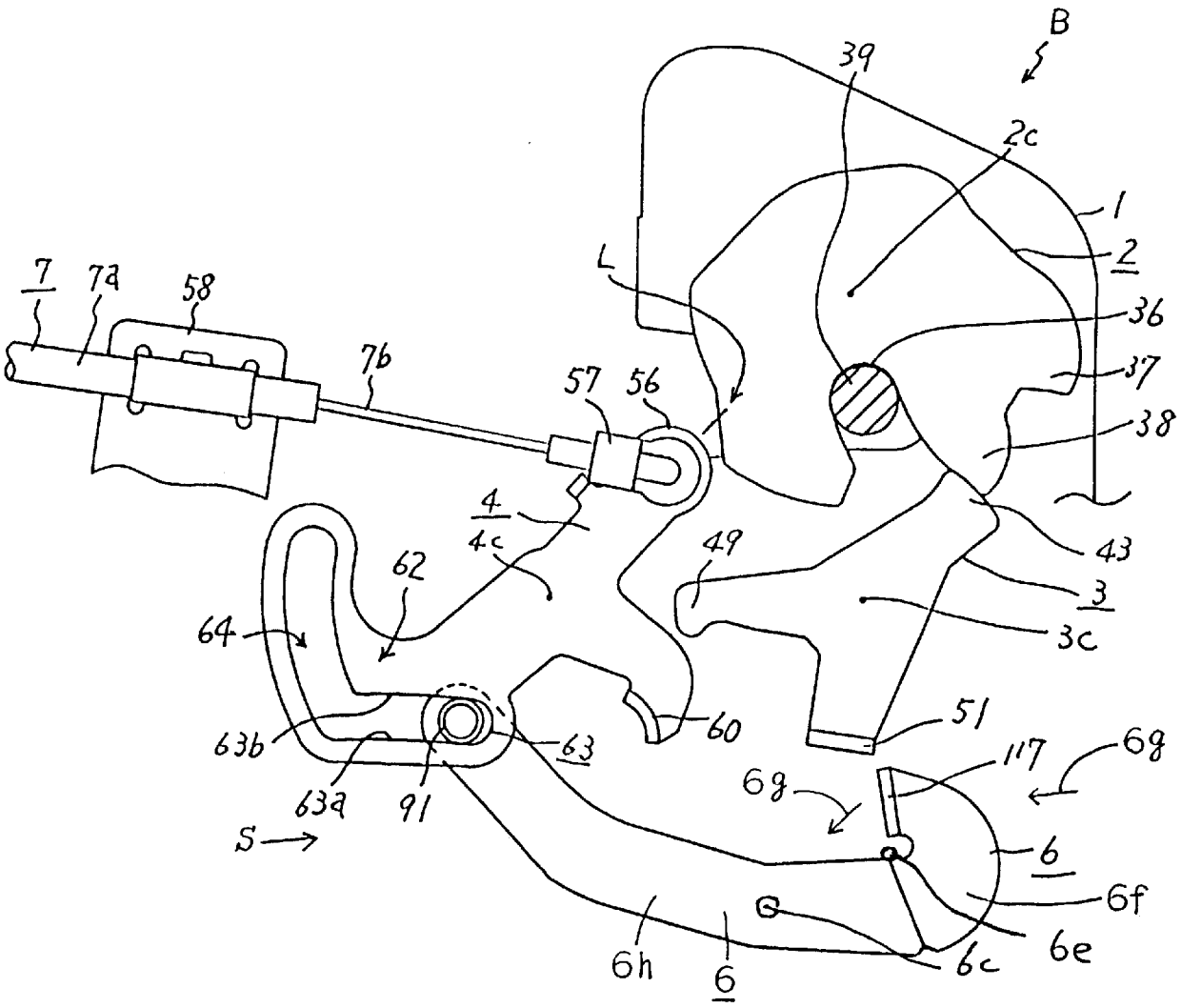
FIG. 7 is a diagram similar to FIG. 6 but showing a locked condition.
Figure 8:
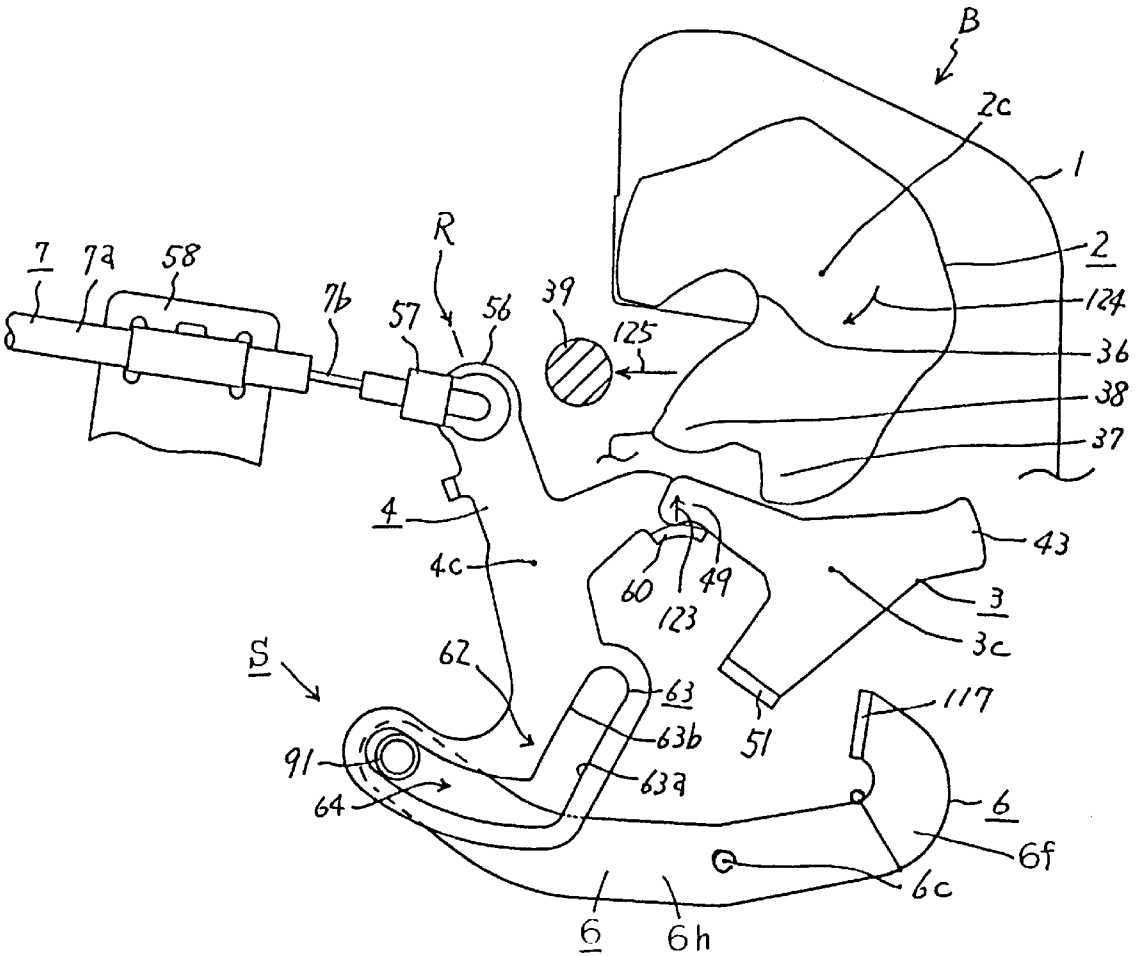
FIG. 8 is a diagram similar to FIG. 6 but showing a released condition.
Figure 9:
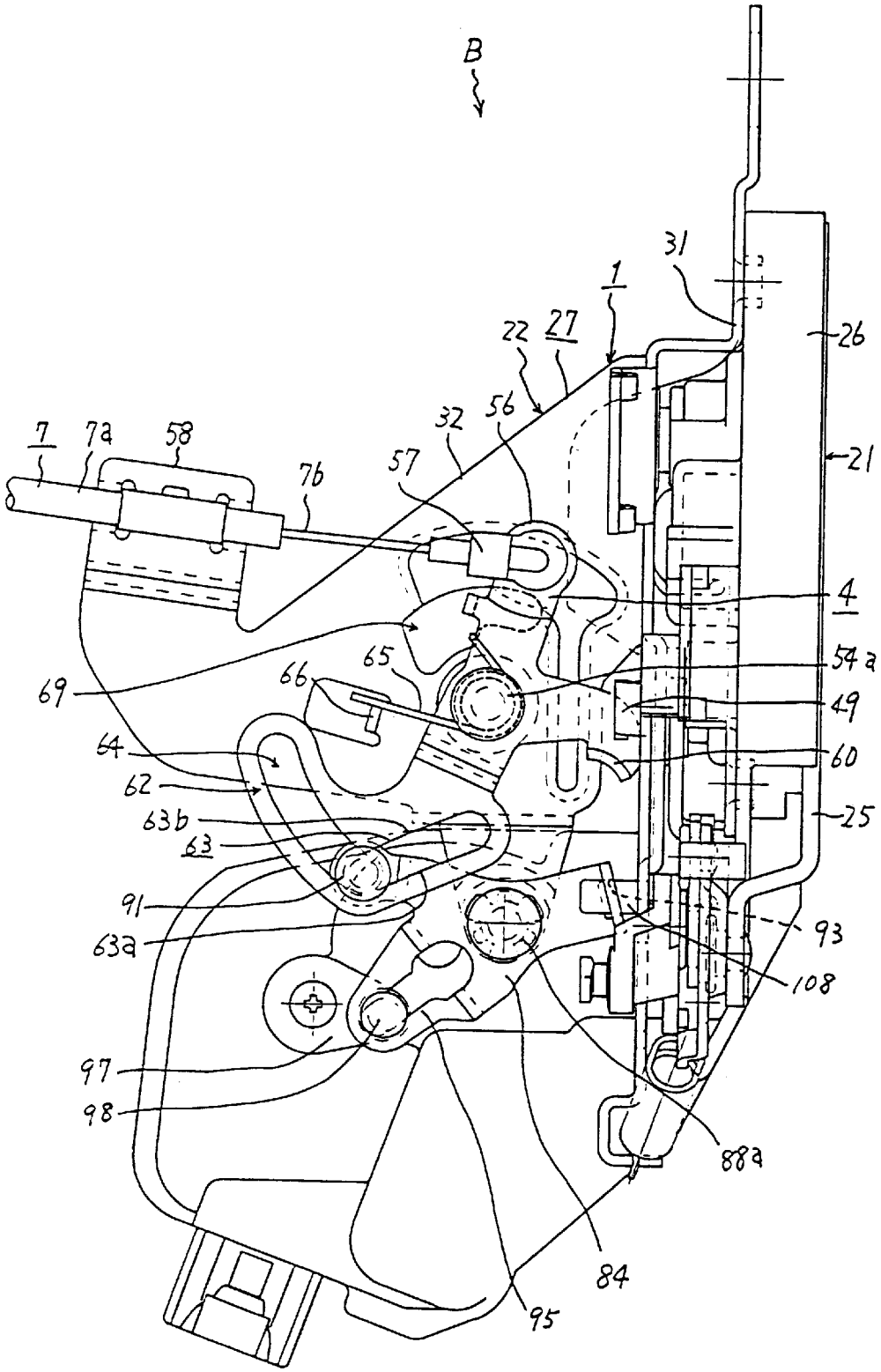
FIG. 9 is a front view of the lock device main unit.
Figure 10:
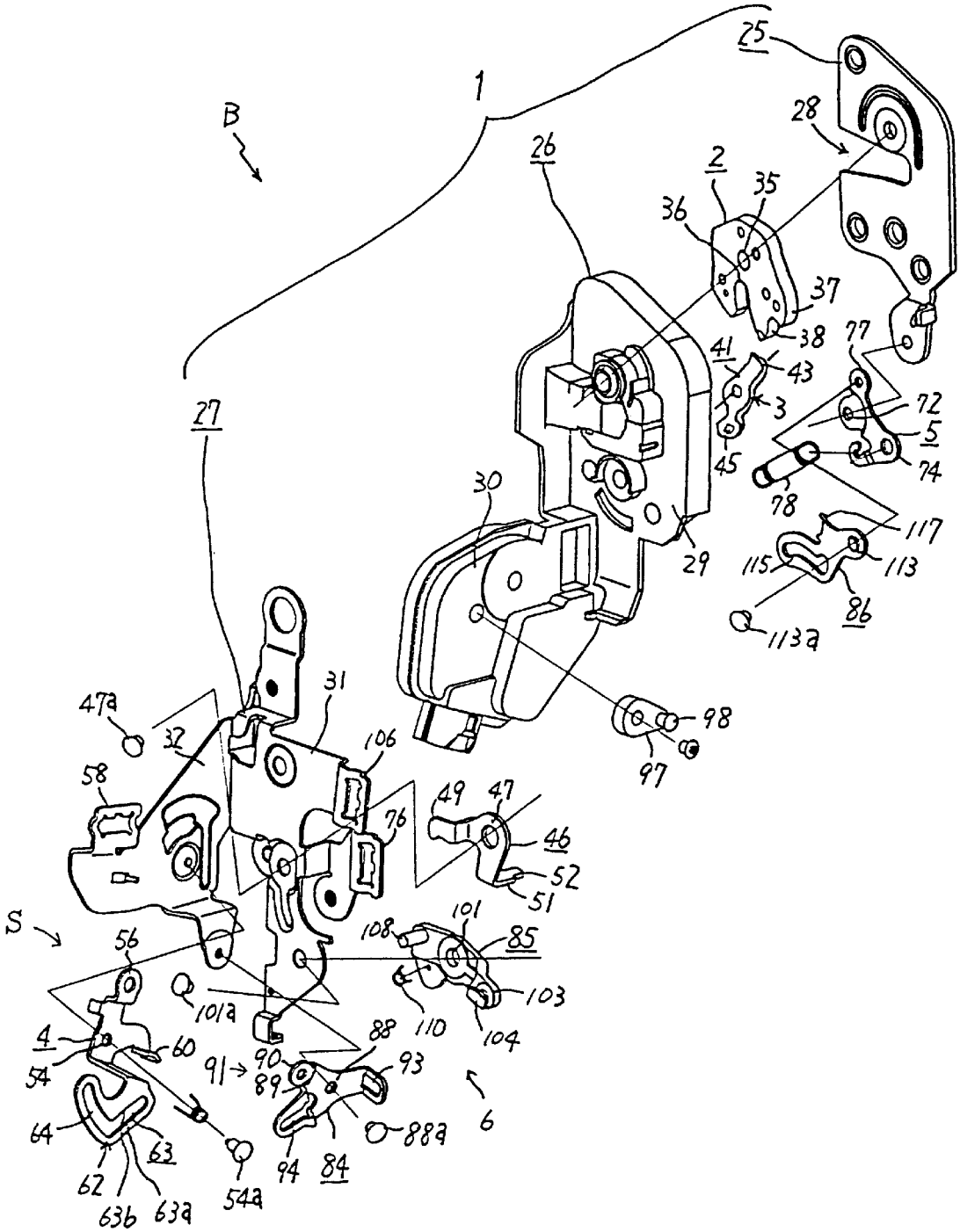
FIG. 10 is an exploded view in perspective of the lock device main unit.

A description will now be given of the basic operating principle of the lock device main unit B with reference to FIGS. 6 to 8 illustrating the basic construction thereof. Reference numeral 1 is a base frame which serves as the base in the lock device main unit B, and 2 is a latch member, rotatably mounted on the base frame 1, for engaging a striker and thereby preventing the door from opening when the door is closed. 2*c* shows the center of its rotation. In the structure of the latch member 2, reference numeral 36 is an engaging portion for engaging the striker 39, 37 is a half-latch pawl, and 38 is a full-latch pawl. Reference numeral 3 is an engaging member, rotatably mounted on the base frame 1, for engaging the latch member 2 to prevent its rotation. In the structure of the engaging member 3, reference numeral 43 is an engaging portion for engaging the half-latch pawl 37 and full-latch pawl 38, 49 is a driven portion for accepting the movement of the releasing operation from the operating member 4 hereinafter described, and 51 is an engaging piece for interlocking with the switching means 6 described later.

Reference numeral 4 is the operating member used to perform operations to put the lock device main unit B into the unlocked condition, locked condition, and released condition; the operating member is pivotably mounted on the base frame 1 in such a manner as to be switchable between the three positions shown in FIG. 6, i.e., the unlocked position U, locked position L, and released position R. 4*c* shows the center of its rotation. The unlocked condition is the condition in which the door is held in the closed condition, and in which a lock mechanism for holding the door in the closed condition (a mechanism consisting of the latch member 2 and engaging member 3) is allowed to be released from its lock engaging condition (the condition in which the latch member 2 is engaged with the engaging member 3) by operation. The locked condition means the condition in which the release of the locked condition is prevented. The released condition refers to the condition in which the lock engaging condition is released.

In the structure of the operating member 4, reference numeral 56 is an accepting portion for accepting the operating force from the operating part C; the accepting portion is formed so that a fastener 57 for the wire 7*b* can be attached thereto. Reference numeral 58 indicates a mounting portion for the sheath 7*a*. Reference numeral 60 is a driving portion constructed to engage the driven portion 49 for a releasing operation. Reference numeral 62 is an interlocking portion for interlocking with the switching means 6; this portion consists of a guide portion 63 and a releasing portion 64 formed continuously with the guide portion 63. The guide portion 63 is a portion, formed for example in a shape of an elongated hole, for switching the switching means 6 between the unlocked condition and the locked condition when the operating member 4 moves between the unlocked position U and the locked position L. The guide portion 63 has a first guide face 63*a* for switching the switching means 6 from the unlocked condition to the locked condition when the operating member 4 moves from the unlocked position U to the locked position L, and a second guide face 63*b* for switching the switching means 6 from the locked condition to the unlocked condition when the operating member 4 moves in the reverse direction from the locked position L to the unlocked position U. A releasing portion 64 is provided to cut off the interlocking with the switching means 6 when the operating member 4 moves between the unlocked position U and the released position R, and is formed in such a shape as to prevent a force from being applied from the operating member 4 to the switching means 6 even when the operating member 4 is moving. This portion is formed, for example, in a shape of an elongated hole curved along an arc with its center at a center of rotation 4*c* of the operating member 4.

Reference numeral 6 is the switching means for switching the lock device main unit B between the unlocked and locked conditions; the switching means is constructed from a lever having, for example, a portion 6*e* pivotably attached, and is mounted, for example, in rotatable fashion on the base frame 1. 6*c* shows a center of its rotation. In the structure of the switching means 6, reference numeral 91 is an interlocking member for interlocking with the operating member 4; the interlocking member is engaged in grooved cam-like elongated holes 63 and 64 in the interlocking portion 62 of the operating member 4. Reference numeral 117 is an interlocking portion for driving and pushing the engaging piece 51 to disengage the engaging member 3 from the latch member 2; this interlocking portion is constructed to be movable separately from the main member 6*h* of the switching means 6 by being pushed in the direction of arrow 6*g* by means of an external member. The switching means 6 and the operating member 4 together constitute a switching mechanism S.

Figure 3:
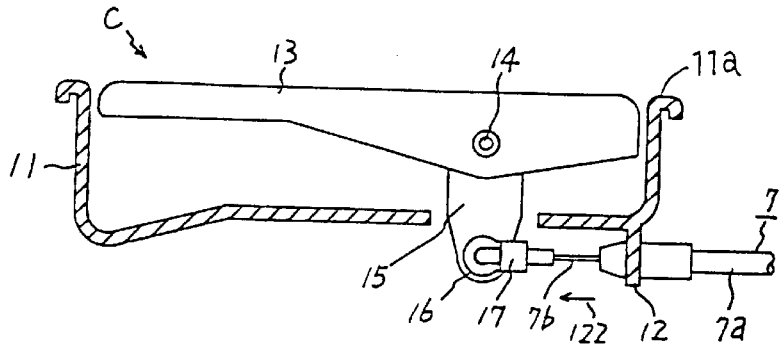
FIG. 3 is a cross-sectional view showing the operation of an operating part on the interior side of the door.

In the above-described construction, when the vehicle door is closed, and the handle 13 in the operating part C is in the unlocked position as shown in FIG. 3, the lock device main unit B is in the condition shown in FIG. 6. That is, the striker 39 is engaged with the engaging portion 36 of the latch member 2, and the full-latch pawl 38 is engaged with the engaging pawl 43 of the engaging member 3. Accordingly, the rotation of the latch member 2 (clockwise rotation about the center of rotation 2*c*) is prevented, and the striker 39 is held immobilized in the condition shown, thus holding the door in the closed condition.

Figure 4:
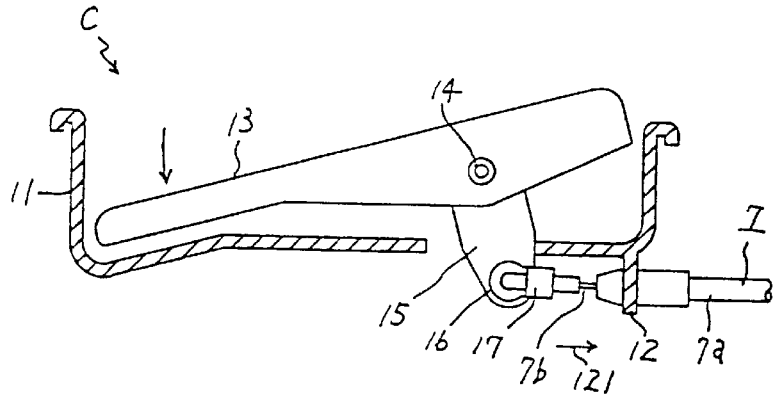
FIG. 4 is a cross-sectional view showing the operation of the operating part on the interior side of the door.

When the handle 13 is moved from the condition of FIG. 3 to the locked position as shown in FIG. 4, the wire 7*b* is pushed in a direction of arrow 121. This causes the operating member 4 in the lock device main unit B to move to the locked position L as shown in FIG. 7. During this moving process, the guide face 63*a* of the guide portion 63 mechanically pushes the interlocking member 91, which causes the switching means 6 to disengage from the locked condition, disengaging the interlocking portion 117 from the position opposite the engaging piece 51, for example, as shown in the figure, thus entering a condition in which the interlocking piece 117 is disabled from driving to push the engaging piece 51 even when the member 6*f* is turned in a direction of arrow 6*g*.

When the handle 13 is moved from the condition of FIG. 4 back to the unlocked position shown in FIG. 3, the wire 7*b* is pulled in a direction of arrow 122. This causes the operating member 4 in the lock device main unit B to move to the unlocked position as shown in FIG. 6. During this moving process, the guide face 63*b* of the guide portion 63 mechanically pushes the interlocking member 91, which causes the switching means 6 to enter the unlocked condition, with the interlocking portion 117 moving into the position opposite the engaging piece 51, for example, as shown in the figure, where the driving of the interlocking piece 117 to push the engaging piece 51 is enabled. In the case of this operation, the operating force for the unlocking action applied from the wire 7*b* to the operating member 4 is transmitted directly to the switching means 6 through the engagement of the rigid members, i.e., the guide face 63*b* and the interlocking member 91. Accordingly, if the movement of the switching means 6 becomes heavy because of some freezing or rusting, the operating force is forcefully transmitted to the switching means 6 to forcefully operate the switching means 6, thus ensuring reliable switching to the unlocked condition.

Figure 5:
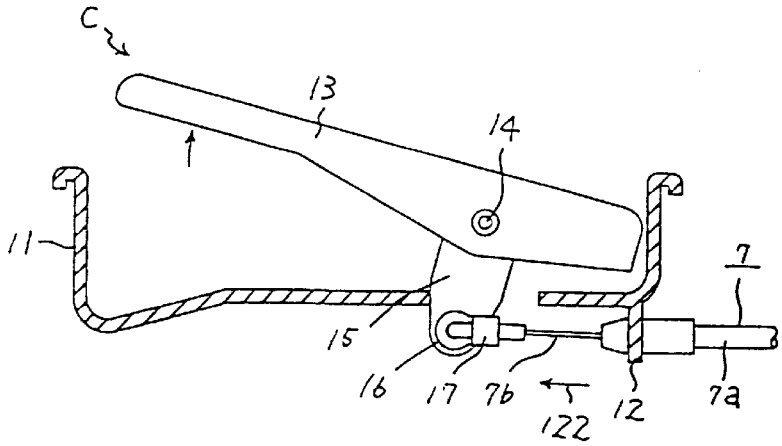
FIG. 5 is a cross-sectional view showing the operation of the operating part on the interior side of the door.

When the handle 13 is moved from the condition of FIG. 3 to the released position shown in FIG. 5, the wire 7*b* is pulled further in the direction of arrow 122. This causes the operating member 4 in the lock device main unit B to move to the released position R as shown in FIG. 8. With this movement, the driving portion 60 pushes the driven portion 49 of the engaging member 3 in a direction of arrow 123, disengaging the engaging pawl 43 from the full-latch pawl 38. As a result, the latch member 2 is allowed to turn in a direction of arrow 124, disengaging the striker 39 from the engaging portion 36 as shown by arrow 125, and the vehicle door opens. In the case of this operation, the relationship between the operating member 4 and the switching means 6 is such that the interlocking member 91 always stays in the same position because the arc along which the releasing portion 64 of the interlocking portion 62 has a radius with its center at the center of rotation 4*c*; therefore, if the operating member 4 is turned, no force is transmitted to the switching means 6. Accordingly, the force needed to operate the handle 13 for the releasing operation is relatively small, that is, a force just sufficient to disengage the engaging member 3 from the latch member 2 through the cable 7 and the operating member 4 will suffice.

Figure 11:
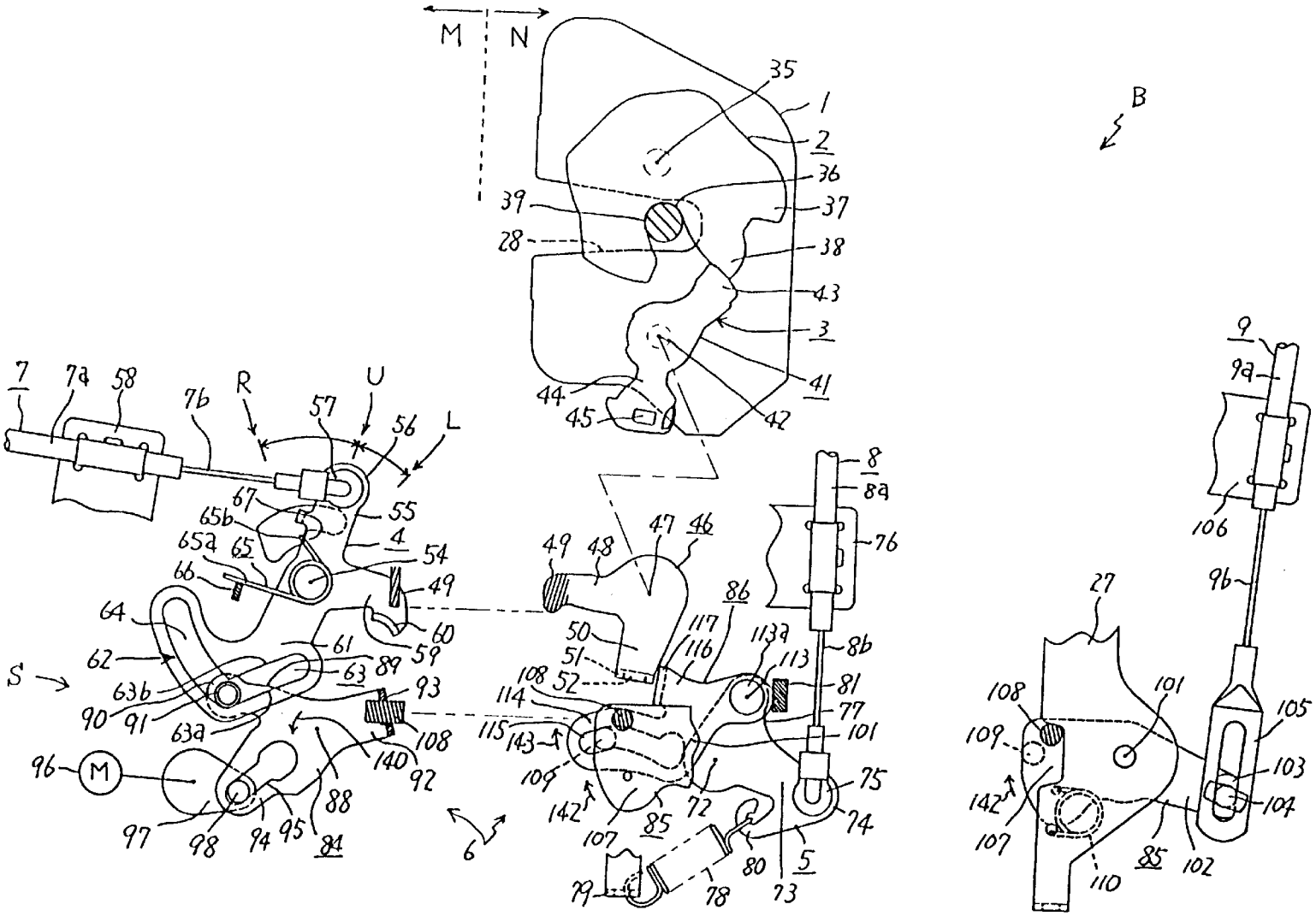
FIG. 11 is a diagram showing various members of the lock device main unit in the unlocked condition.
Figure 12:
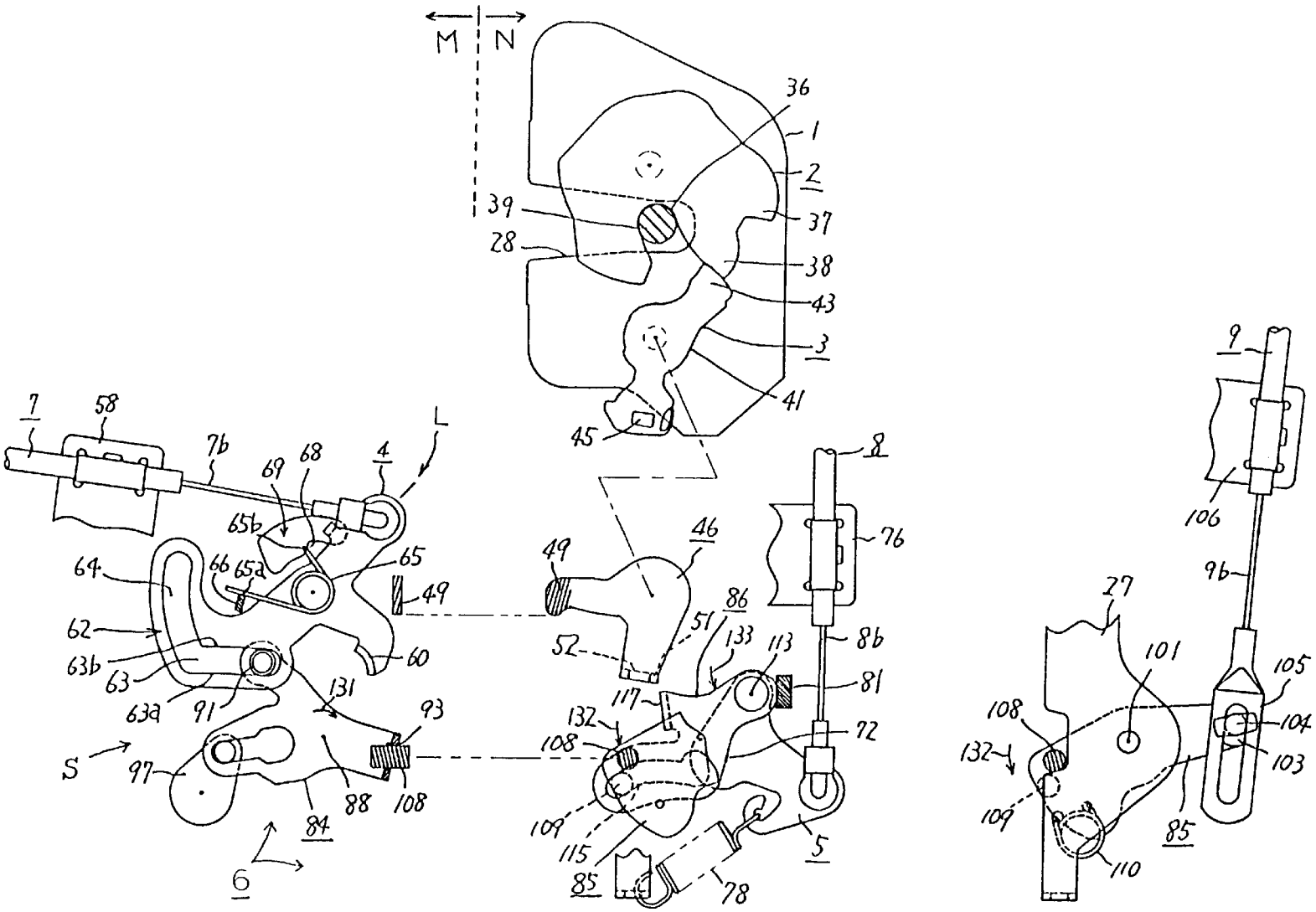
FIG. 12 is a diagram similar to FIG. 11 but showing the members in the locked condition.
Figure 13:
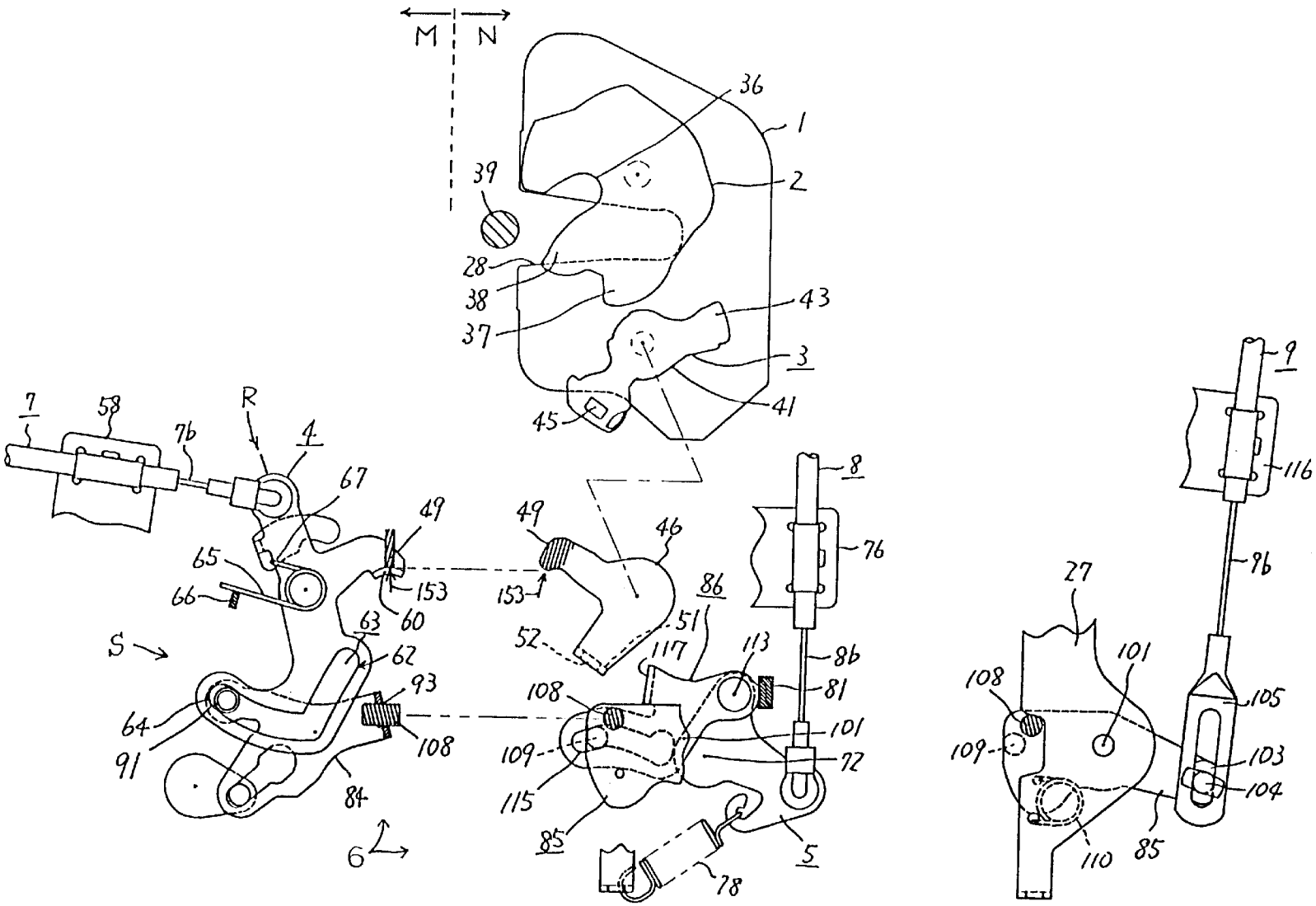
FIG. 13 is a diagram similar to FIG. 11 but showing the members in the released condition.

Next, a specific example of the lock device main unit B will be described in detail with reference to FIG. 2 and FIGS. 9 to 15. FIGS. 11 to 13 are expansion views showing the respective members of the lock device main unit B; part M and part B show in spread form the members arranged facing each other at angles of about 90 degrees.

The lock device main unit B includes the base frame 1 and the latch member 2, engaging member 3, operating member 4, outside open lever 5, and switching means 6 mounted on the base frame 1. Each member will be described below.

The base frame 1 serves as the base for mounting the various members in the lock device main unit B. The base frame 1 consists of a parallel portion 21 which is positioned substantially parallel to an end face of the free end side of the door when mounted on the vehicle door, and a perpendicular portion 2 2 which is substantially perpendicular to the parallel portion 21. Arrow 23 indicates the free end side of the door, and 24 the interior side of the door. The base frame 1 is constructed to have a sufficient strength as the base, using a metal base 25, a plastic body 26, and a metal backplate 27. These parts are joined as one unit by joining means not shown. A portion 28 formed in the base 25 is an opening for accommodating the striker. The body 26 and the backplate 27 have parallel portions 29 and 31 and perpendicular portions 30 and 32, respectively.

The latch member 2 works to prevent the opening of the door by engaging on the striker 39 when the door is closed; the latch member 2 is rotatably mounted on the frame 1. More specifically, reference numeral 35 is a pivoting portion which is pivotably mounted on the base 25 and body 26 by means of a pivoting member not shown.

Reference numeral 36 is an engaging portion for engaging the striker 39, 37 is a half-latch pawl, and 38 is a full-latch pawl.

The engaging member 3 is for engaging the latch member 2 to prevent its rotation, and is rotatably mounted on the base frame 1 to enable engagement and release of the engagement. A detailed description will be given below. Reference numeral 41 is a pole in the engaging member 3, and its pivoting portion 42 is pivotably mounted on the base 25 and body 26 by means of a pivoting member not shown.

Reference numeral 43 is an engaging pawl for engaging the half-latch pawl 37 and full-latch pawl 38. Reference numeral 44 is an arm for interlocking with the transmitting member hereinafter described; the arm has an interlocking engaging hole 45. Reference numeral 46 is the transmitting member provided in the engaging member 3 for interlocking with the operating member 4, and its pivoting portion 47 is pivotably mounted by means of a pin 47*a* concentrically with the pole 41. Reference numeral 48 is a first arm which is provided in the transmitting member 46 for interlocking with the operating member 4, and which has a driven portion 49 for accepting the movement of a releasing operation. Reference numeral 50 is a second arm which is provided for interlocking with the switching means 6 and pole 41, and has engaging pieces 51 and 52 for interlocking with them. The engaging piece 52 engages with the engaging hole 45 so that the pole 41 and the transmitting member 46 are rotated in integral fashion.

The operating member 4 is a member for performing operations to put the lock device main unit B into the unlock condition, lock condition, and released condition, and is made switchable between the three positions shown in FIG. 11, i.e., unlocked position U, locked position L, and released position R. The operating member 4 is switched between these positions by operating the operating part C on the interior side, and is also called an inside open lever. Reference numeral 54 shows the pivoting portion of the operating member 4, which is pivotably mounted on the backplate 27 by means of a pin 54*a*, making the operating member 4 switchable between the three positions. Reference numeral 55 is a first arm of the operating member 4, for accepting the operating force from the operating part C, and an accepting portion 56 for accepting the operating force is provided at the tip thereof. The operating portion 56 is also a connecting portion for connecting the wire 7*b* of the cable 7, and is formed so that a fastener 57 for the wire 7*b* can be attached thereto. Further, 58 is a fastening portion for the sheath 7*a* of the cable 7; this portion is formed on the backplate 27. Reference numeral 59 is a second arm which is formed for interlocking with the engaging member 3 and is provided at its tip with the driving portion 60 that engages the driven portion 49 to perform a releasing operation. Reference numeral 61 is a third arm which is provided with the interlocking portion 62 for interlocking with the switching means 6.

The interlocking portion 62 consists of the guide portion 63 and the releasing portion 64 formed continuously with the guide portion 63. The guide portion 63 is a portion for switching the switching means 6 between the unlocked condition and the locked condition when the operating member 4 moves between the unlocked position U and the locked position L. The guide portion 63 has the first guide face 63*a* for switching the switching means 6 from the unlocked condition to the locked condition when the operating member 4 moves from the unlocked position U to the locked position L, and the second guide face 63*b* for switching the switching means 6 from the locked condition to the unlocked condition when the operating member 4 moves in the reverse direction from the locked position L to the unlocked position U. The guide portion 63 is formed, for example, in the shape of an elongated hole whose opposing side faces are formed as the guide faces 63*a* and 63*b*; alternatively, the guide portion 63 may be formed, for example, in a shape of an elongated groove, and its opposing side walls may be formed as the guide faces. The releasing portion 64 is provided to cut off the interlocking with the switching means 6 when the operating member 4 moves between the unlocked position U and the released position R, and is formed in such a shape as to prevent the force from being applied from the operating member 4 to the switching means 6 even when the operating member 4 is moving. This portion is formed, for example, in the shape of an elongated hole curved along an arc with its center at the center of rotation of the operating member 4. Reference numeral 65 is a spring for returning the operating member 4 from the released position R to the unlocked position U, and for holding the operating member 4 in that position. Its one end 65*a* is engaged with a spring retainer 68, formed on the backplate 27. The other end 65*b* is positioned facing and stretching over a spring retainer 67 formed on the first arm 55 and a spring retainer 68 formed on the backplate 27. As a result, when the operating member 4 is located somewhere between the released position R and the unlocked position, the other end 65*b* is engaged with the spring retainer 67, urging the operating member 4 toward the unlocked position U, and when the operating member 4 is located somewhere between the unlocked position U and the locked position L, the other end 65*b* is engaged with the spring retainer 68, preventing the urging force from being applied to the operating member 4. Reference numeral 69 is a throughhole formed in the backplate 27 to form the spring retainer 68.

The outside open lever 5 is a member for putting the lock device main unit B into the released condition by accepting the operation from the operating part on the exterior side of the door, and is made switchable between the normal position shown in FIG. 11 and the released position shown in FIG. 13. Its pivoting portion 72 is pivotably mounted, for example, on the base 25. Reference numeral 73 is a first arm of the lever 5; the first arm is a portion for accepting the operating force from the above-mentioned operating part, and is provided at its end with an accepting portion 74 for accepting the operating force. The accepting portion 74 is also a connecting portion for connecting the wire 8*b* of the cable 8, and is formed so that a fastener 75 for the wire 8*b* can be attached thereto. Further, 76 is a fastening portion for the sheath 8*a* of the cable 8; this portion is formed on the backplate 27. Reference numeral 77 is a second arm for interlocking with the switching means 6. Reference numeral 78 is a spring for urging the lever 5 to the normal position; its one end is hooked on a spring hook 79 formed on the backplate 27, and the other end is hooked on a spring hook 80 formed on the lever 5. Further, 81 is a stopper for stopping the lever 5 in its normal position.

The switching means 6 is for switching the lock device main unit B between the unlocked condition and the locked condition; shown here is an example in which the switching means 6 is constructed with an inside locking lever 84, an outside locking lever 85, and a control lever 86.

The inside locking lever 84 is a lever for effecting the above-stated switching of the lock device main unit B by the operation from the operating part C on the interior side of the door, and is made switchable between the unlocked condition shown in FIG. 11 and the locked condition shown in FIG. 12. To enable such position switching, its pivoting portion 88 is pivotably mounted, for example, on the backplate 27 by means of a pin 88*a*. Reference numeral 89 is a first arm provided in the lever 84 for interlocking with the operating member 4, and its tip is formed as an interlocking portion 90 where a pin 91 illustrated as an interlocking member is attached. The pin 91 is engaged in the elongated holes 63 and 64 in the interlocking portion 62 of the operating member 4. Reference 92 is a second arm for interlocking with the outside open lever 85; a throughhole 93 illustrated as an interlocking portion is opened through the second arm.

Reference numeral 94 is a third arm which is used to switch the switching means 6 between the locked and unlocked conditions by motor operation, and which is provided with an elongated hole 95 illustrated as an operating force accepting portion. Reference numeral 96 indicates the motor for performing the switching operation; a pin 98 is attached to a lever 97 which is driven for rotation by the motor 96, and the pin 98 is engaged in the elongated hole 95. In the illustrated construction, the locking lever 84 is switched between the unlocked and locked conditions by rotating the lever 97 by the motor 96.

The outside locking lever 85 is a lever for effecting the above-stated switching of the lock device main unit B by the operation from the operating part on the exterior side of the door, and is made switchable between the unlocked condition shown in FIG. 11 and the locked condition shown in FIG. 12. To enable such position switching, its pivoting portion 101 is pivotably mounted, for example, on the backplate 27 by means of a pin. Reference numeral 102 is a first arm for accepting the operating force from the operating part on the exterior side of the door; its tip is formed as an accepting portion 103 which is provided with an engaging member 104 for engaging with a linking part 105 attached to the end of the wire 9*b* of the cable 9. Further 106 is a fastening portion for the sheath 9*a* of the cable 9; this portion is formed on the backplate 27. Reference numeral 107 is a second arm which is provided for interlocking with the inside locking lever 84 and control lever 86, and has interlocking pieces, for example, projecting pieces 108 and 109, for interlocking with them. The interlocking operation with the inside locking lever 84 is performed by engaging the projecting piece 108 in the throughhole 93. Reference numeral 110 is a spring, interposed between the lever 85 and the backplate 27, for holding the switching means 6 in position when switched to the locked condition or unlocked condition.

The control lever 86 is a lever for accomplishing the locked condition of the lock device main unit B; this lever holds the lock device main unit B in the locked condition by preventing the operating force of the outside open lever 5 from being transmitted to the engaging member 3 when the inside locking lever 84 and the outside locking lever 85 are placed in the locked condition. The lever 86 has a pivoting portion 113 which is pivotably mounted on the second arm 77 of the outside open lever 5 by means of a pin 113*a*. Reference numeral 114 is a first arm which is provided with an elongated hole 15 illustrated as an interlocking portion for interlocking with the outside locking lever 85; the interlocking piece 109 is engaged in the elongated hole 115. The elongated hole 115 is formed in the elongated shape as shown so as to guide the direction of movement of the control lever 86 during the releasing operation from the outside open lever 5. Reference numeral 116 is a second arm for interlocking with the engaging portion 3; the second arm has an interlocking portion 117 for driving the engaging piece 51 by pushing.

In the above construction, when the vehicle door is closed, and the handle 13 in the operating part C is in the unlocked position as previously shown, the lock device main unit B is in the unlocked condition as shown in FIG. 11. More specifically, the operating member 4 is in the unlocked position U, the striker 39 is engaged with the engaging portion 36 of the latch member 2, and the engaging pawl 43 of the engaging member 3 engages the full-latch pawl 38; as a result, clockwise rotation of the latch member 2 is prevented, and the striker 39 is held immobilized in the condition shown, thus holding the door in the closed condition.

When the handle 13 is moved into the locked position as previously shown, the lock device main unit B is placed into the locked condition as shown in FIG. 12. More specifically, when the wire 7*b* is pushed by the operation of the handle 13, the operating member 4 moves into the locked position L as shown in FIG. 12. During this moving process, the guide face 63*a* of the guide portion 63 mechanically pushes the interlocking member 91, which causes the inside locking lever 84 to turn in a direction of arrow 131, thus entering the locked condition as shown. The movement of the lever 84 is transmitted to the outside locking lever 85 via the interlocking portion 93 and interlocking piece 108, and the lever 85 is turned in a direction of arrow 132 to enter the locked condition. The movement is further transmitted from the lever 85 to the control lever 86 which is then turned in a direction of arrow 133 to enter the locked condition, that is, the condition in which the interlocking portion 117 is displaced from the position opposite the engaging piece 51 as shown in FIG. 12.

Figure 14:
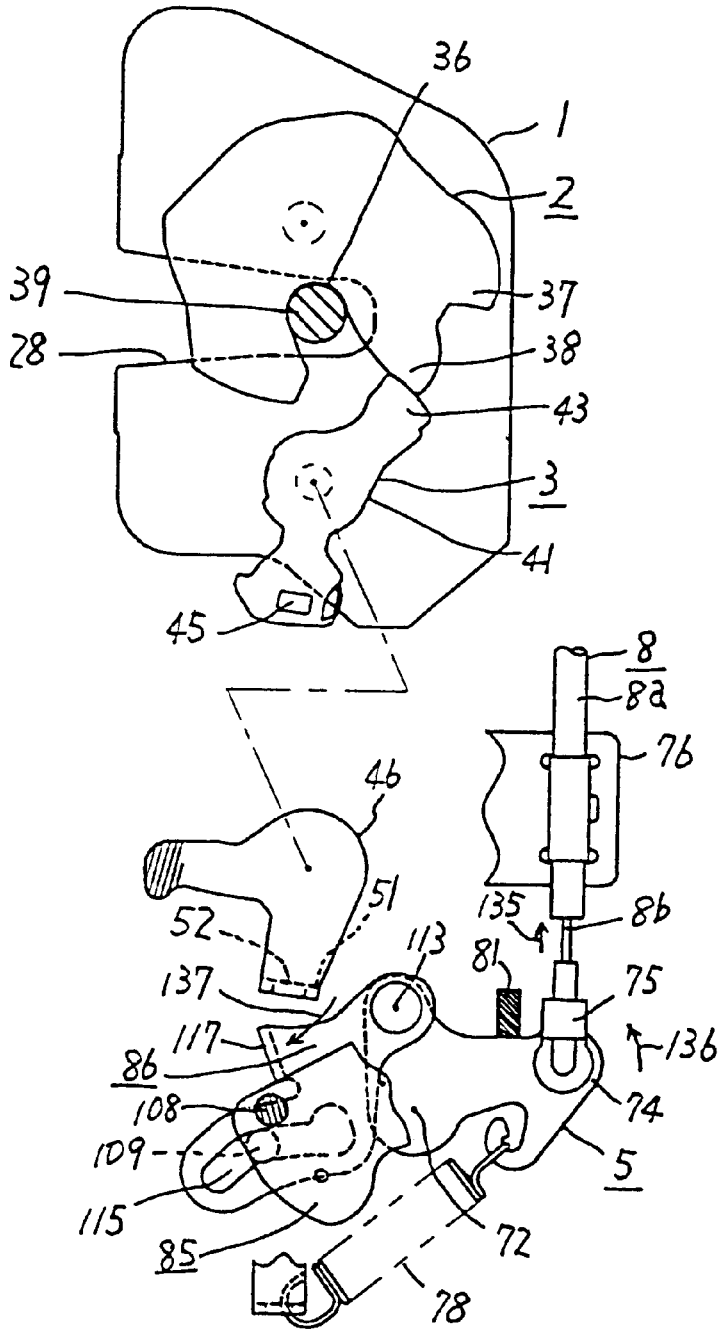
FIG. 14 is a diagram similar to FIG. 12 and showing the condition in which an outside open lever is operated in the locked condition.
Figure 15:
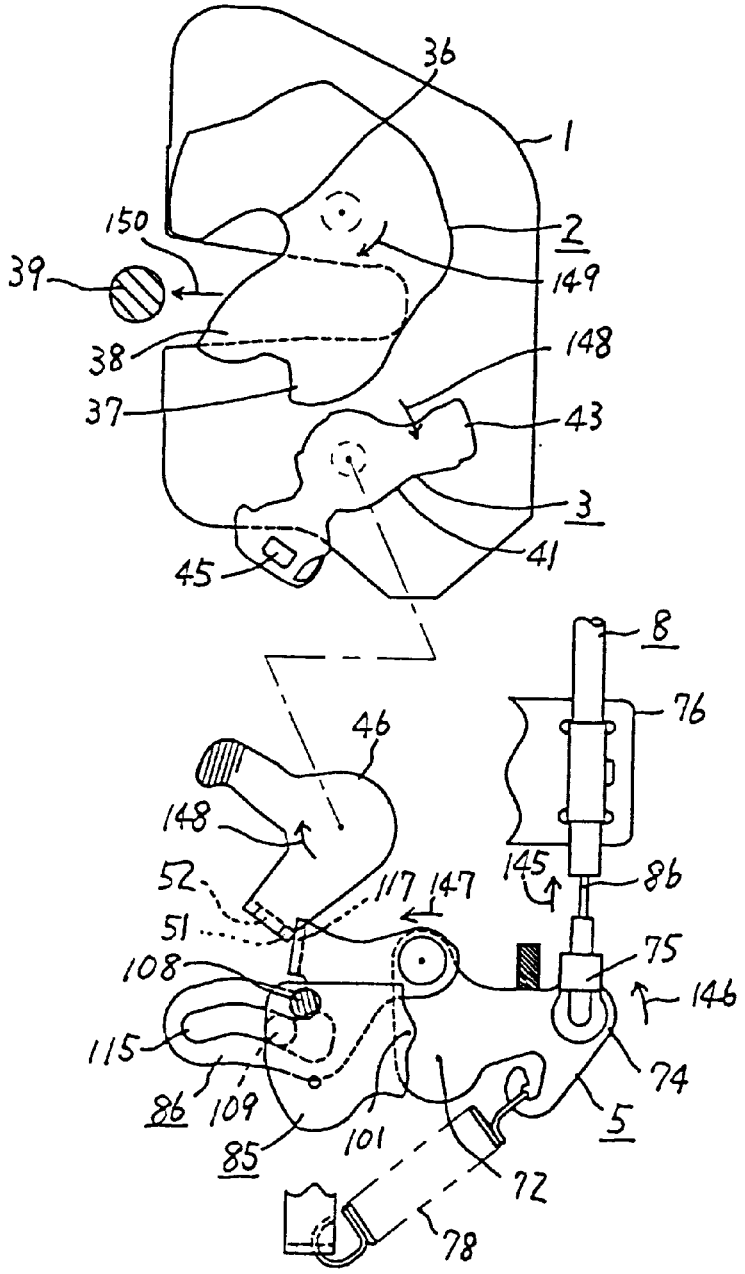
FIG. 15 is a diagram similar to FIG. 11 and showing the condition in which the outside open lever is operated in the unlocked condition.
Figure 16:
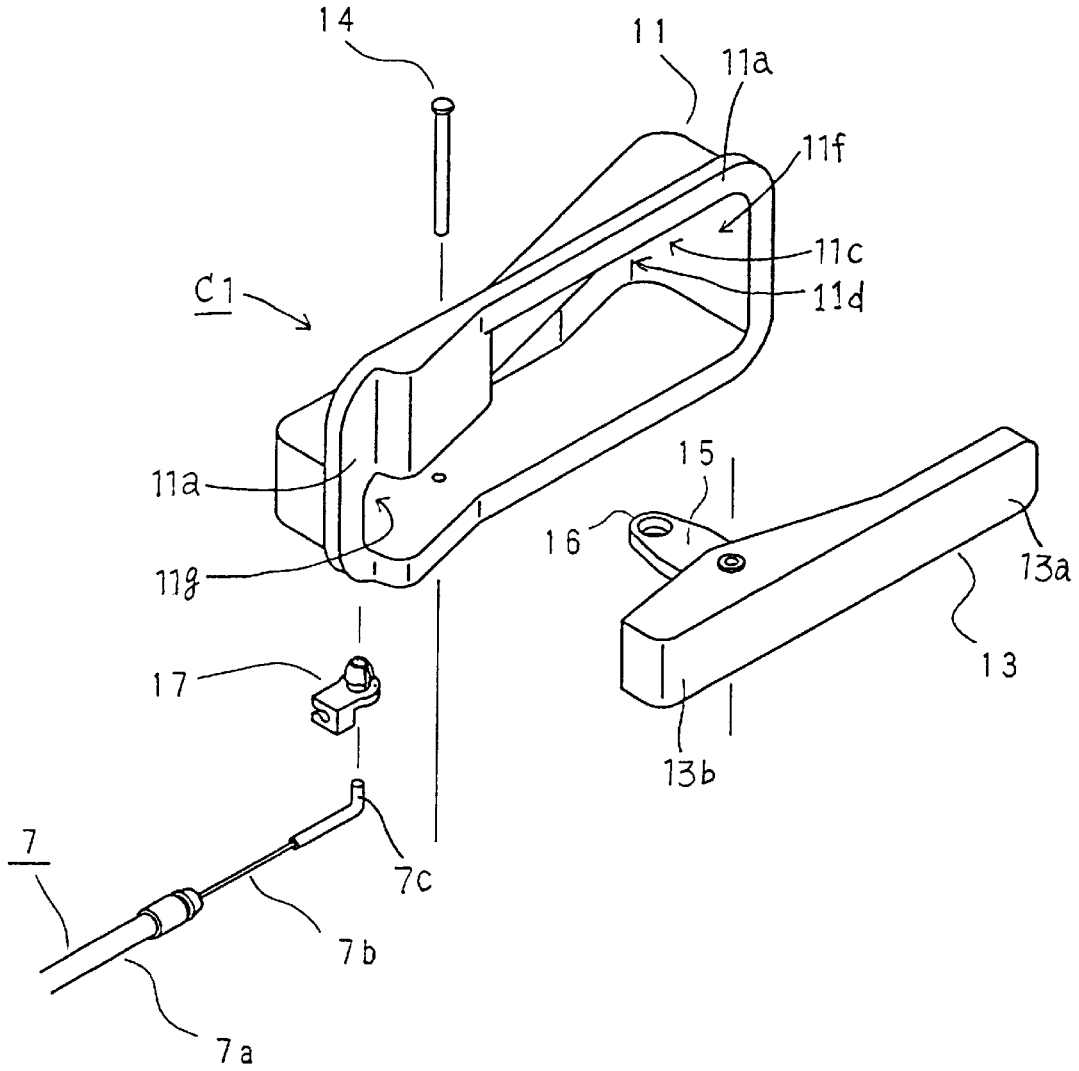
FIG. 16 is an exploded view in perspective of an operating part.
Figure 17:
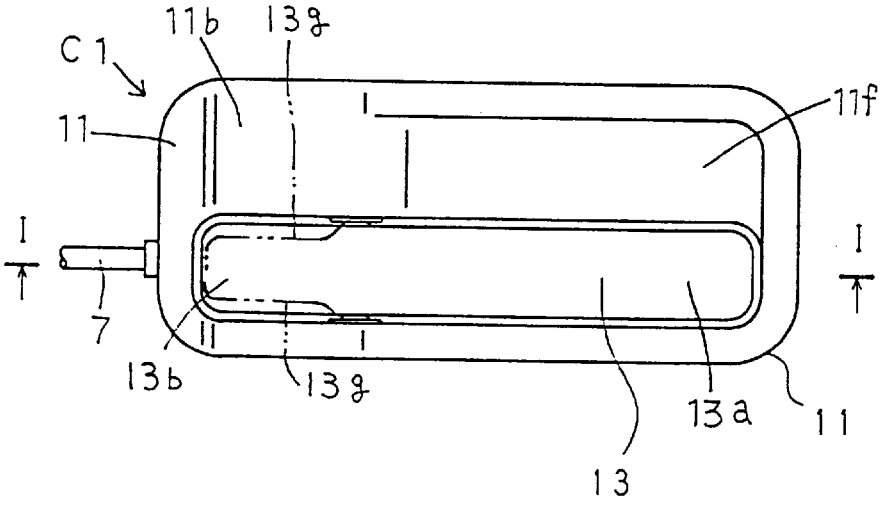
FIG. 17 is a plan view of the operating part.

When the lock device main unit B is in the locked position, as described above, even if the operating part on the exterior side of the door is operated in the releasing direction, in the lock device main unit B the latch member 2 remains engaged with the engaging member 3, and thus the door closed condition is maintained. More specifically, when the operating part on the exterior side of the door is operated in the releasing direction, the wire 8*b* of the cable 8 is pulled in a direction of arrow 135 as shown in FIG. 14. This causes the outside open lever 5 to rotate in a direction of arrow 136. This rotating motion in turn causes the control lever 86 to move. However, since the interlocking portion 117 is not in the position opposite the engaging piece 51, the control lever 86 only moves in a direction of arrow 137, while the engaging member 3 remains immobilized. Accordingly, the latch member 2 remains engaged with the engaging member 3. Here, the movement of the control lever 86 in the direction of arrow 137 is guided by the elongated hole 115. When the releasing operation of the operating part on the exterior side of the door is stopped, the outside open lever 5 is returned to the position of FIG. 12 by the force of the spring 78.

When the handle 13 is moved back to the unlocked position as previously shown, the lock device main unit B moves back to the unlocked condition. More specifically, when the wire 7*b* is pulled by the operation of the handle 13, the operating member 4 moves into the unlocked position U as shown in FIG. 11. During this moving process, the guide face 63*b* of the guide portion 63 mechanically pushes the interlocking member 91, which causes the inside locking lever 84 to turn in a direction of arrow 140, thus entering the unlocked condition as shown. The movement of the lever 84 is transmitted to the outside locking lever 85 via the interlocking portion 93 and interlocking piece 108, and the lever 85 is turned in a direction of arrow 142 to enter the unlocked condition. The movement is further transmitted from the lever 85 to the control lever 86 which is then turned in a direction of arrow 143 to enter the unlocked condition, that is, the condition in which the interlocking portion 117 is positioned opposite the engaging piece 51 as shown in FIG. 11.

In the above unlocking operation, the operating force for the unlocking action applied from the wire 7*b* to the operating member 4 is transmitted to the switching means 6 through the engagement of the rigid members, i.e., the guide face 63*b* and the interlocking member 91. Accordingly, if the movement of any of the inside locking lever 84, outside locking lever 85, control lever 86, and other members of the switching means 6 becomes heavy because of freezing or rusting, the operating force can be forcefully applied from the operating member 4 to the lever 84 to operate it forcefully, and also to forcefully operate the other levers 85 and 86 in turn, and reliable switching to the unlocked condition can thus be ensured.

When the lock device main unit B is in the unlocked condition, as described above, operating the operating part on the exterior side of the door in the releasing direction causes the lock device main unit B to enter the released condition, disengaging the latch member 2 from the engaging member 3 and thus allowing the door to be opened. More specifically, when the operating part on the exterior side of the door is operated in the releasing direction, the wire 8*b* of the cable 8 is pulled as shown by arrow 145 in FIG. 15. This causes the outside open lever 5 to rotate in the direction of arrow 146. This rotating motion causes the control lever 86 to move in a direction of arrow 147.

With this movement, the interlocking part 117 pushes the engaging piece 51, which causes the engaging member 3 to turn in a direction of arrow 148, disengaging the engaging pawl 43 from the full-latch pawl 38. The latch member 2 is now allowed to turn in a direction of arrow 149, and the striker 39 is disengaged from the engaging portion 36 as shown by arrow 150, allowing the vehicle door to be opened.

When the handle 13 is moved to the released position as previously shown, the lock device main unit B is put in the released condition, allowing the vehicle door to be opened. More specifically, when the wire 7*b* is pulled further by the operation of the handle 13, the operating member 4 moves to the released position R as shown in FIG. 13. With this movement, the driving portion 60 pushes the driven portion 49 of the engaging member 3 in a direction of arrow 153, which causes the engaging pawl 43 to disengage from the full-latch pawl 38. The door is now allowed to be opened, as described above. In the case of this operation, the operating force needed to operate the handle 13 is relatively small, as in the case previously described with reference to FIG. 8, that is, a force just sufficient to disengage the engaging member 3 from the latch member 2 through the cable 7 and operating member 4 will suffice.

Figure 18:
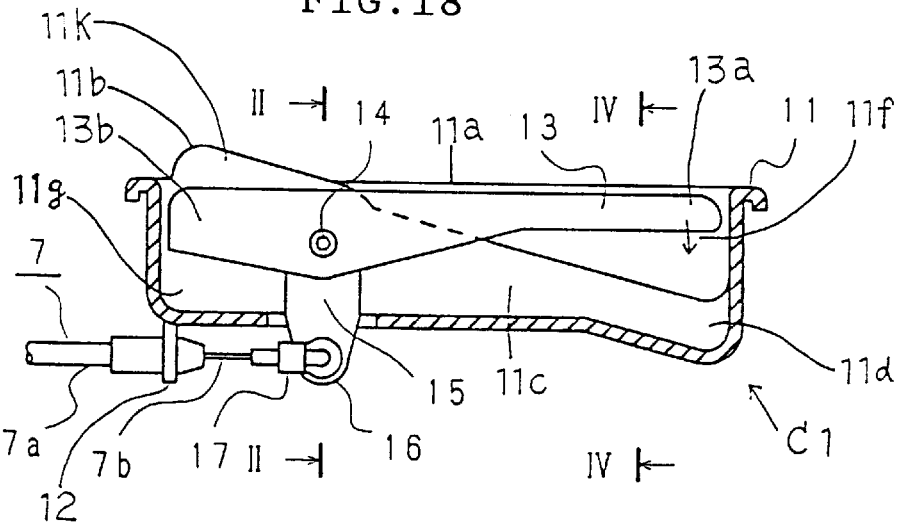
FIG. 18 is a cross-sectional view of the operating part taken along line I—I in FIG. 17.
Figure 19:
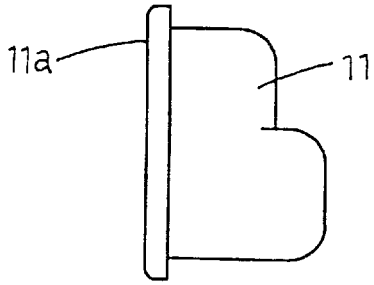
FIG. 19 is a view showing the right-hand side of the operating part of FIG. 17.
Figure 20:
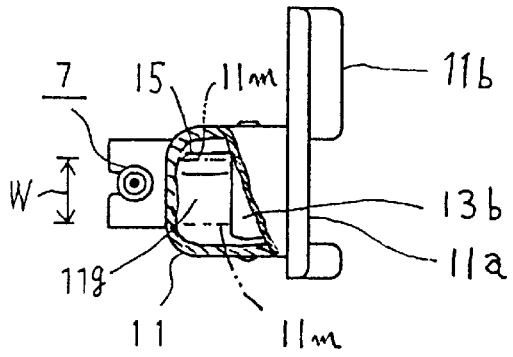
FIG. 20 is a partially cutaway view showing the left-hand side of the operating part of FIG. 17.
Figure 21:
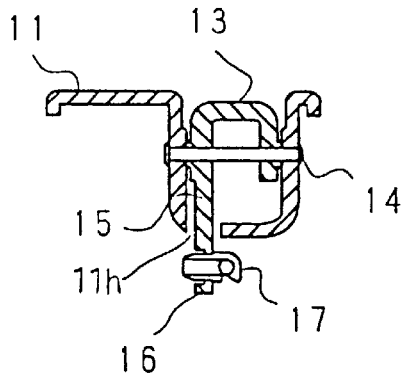
FIG. 21 is a cross-sectional view of the operating part taken along line II—II in FIG. 18.
Figure 22:
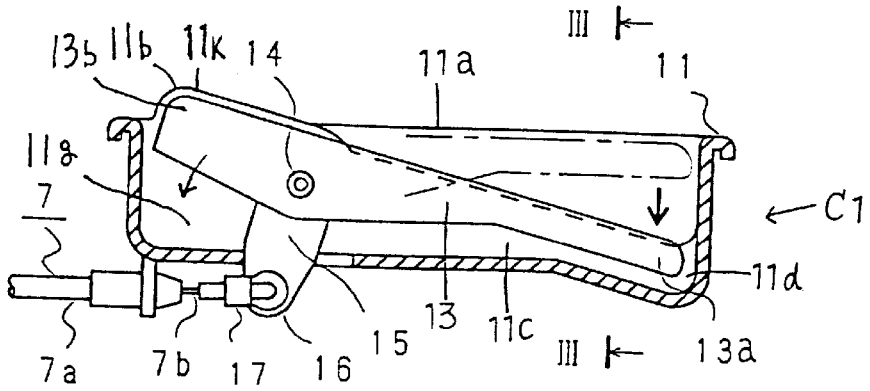
FIG. 22 is a cross-sectional view of the operating part taken along line I—I in FIG. 17.
Figure 25:
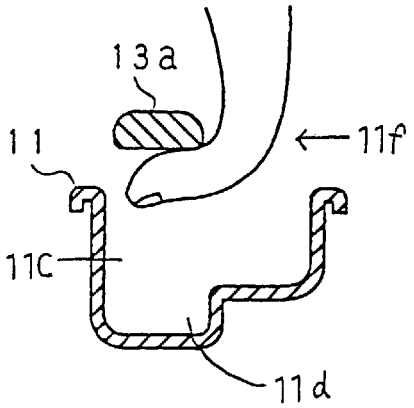
FIG. 25 is a cross-sectional view of the operating part taken along line V—V in FIG. 26.
Figure 26:
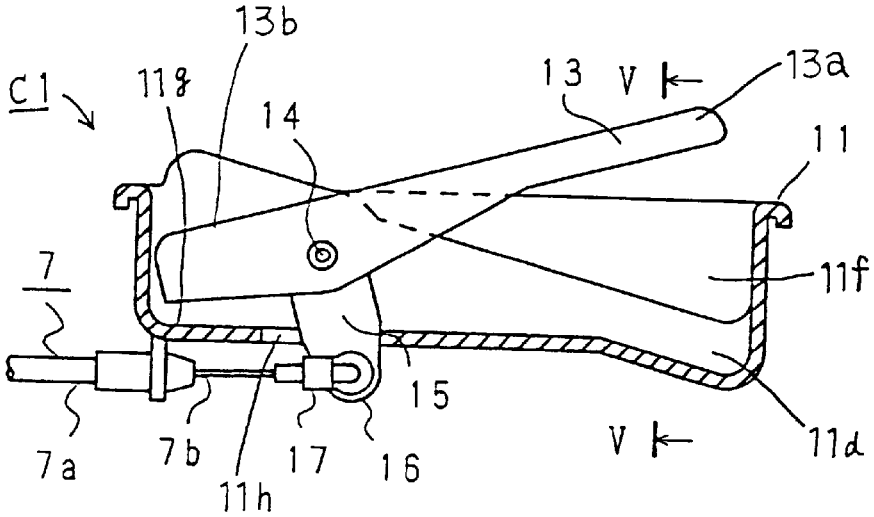
FIG. 26 is a cross-sectional view of the operating part taken along line I—I in FIG. 17.
Figure 27:
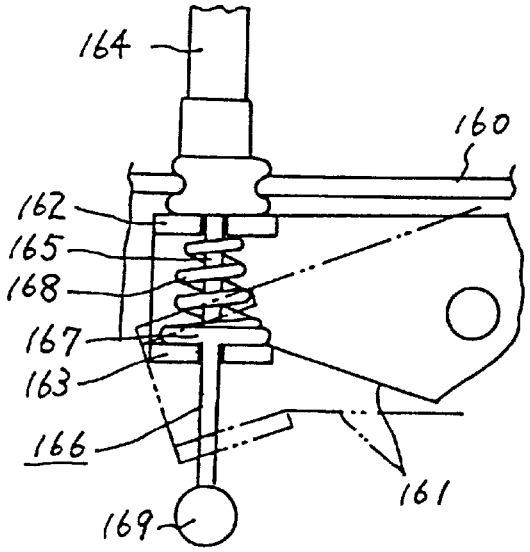
FIG. 27 is a diagram of a switching means, showing interlocking between a locking lever and an operating part according to the prior art.

The operating part C in FIGS. 3, 4, and 5 was shown for the purpose of explaining the basic operation; now, the operating part C1 shown in FIGS. 16 to 26 will be described below to explain additional functions. Those parts considered substantially identical in function and construction to the members shown in FIGS. 3, 4, and 5 are designated by the same reference numerals, and explanatory descriptions of such parts will not be repeated. FIGS. 18, 22, and 26 show the conditions in which the handle 13 is in the "unlocked position," "locked position," and "released position," respectively, corresponding to the operating conditions shown in FIGS. 3, 4, and 5.

Figure 23:
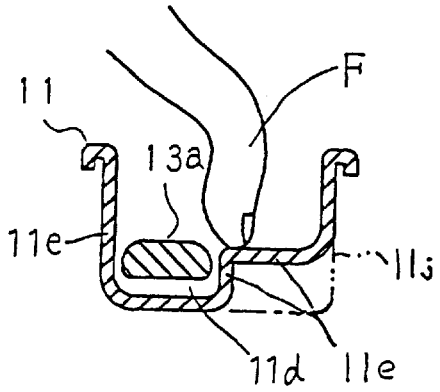
FIG. 23 is a cross-sectional view of the operating part taken along line III—III in FIG. 22.

The frame 11 is embedded with its upper (front) edge 11*a* substantially flush with the interior surface of the door D, as shown in FIG. 1, and the handle 13 is swingably mounted inside an inner recessed portion 11*c*. In the recessed portion 11*c*, there is formed a narrow deeper recessed portion 11*d*, surrounded with walls, for accommodating a main portion 13*a* at one end of the handle 13 in the locked position, the surrounding walls serving to prevent a passenger's finger F from reaching the back of the main portion 13*a* in the locked position, as shown in FIG. 23.

In the recessed portion 11*c*, when the walls of the deep portion 11 are wide as shown by a two-dot chain line, an enclosed portion 11*d* may be formed, rather than forming the narrow deeper recessed portion 11*d*, by arranging separate blocking members in upright fashion on both sides to enclose the main portion 13*a* in the locked position and to prevent the insertion of the finger F. In FIG. 23, the wall members indicated by reference numeral 11*e* act as the blocking members.

Figure 24:
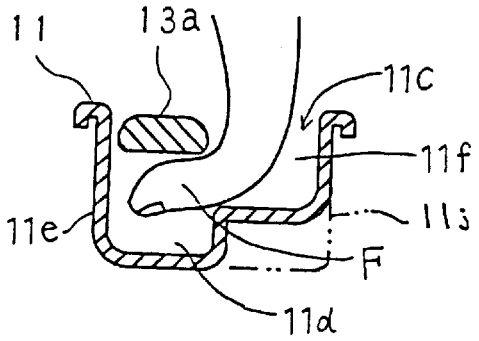
FIG. 24 is a cross-sectional view of the operating part taken along line IV—IV in FIG. 18.

In the recessed portion 11*c*, space 11*f* is an open space formed spaced apart from the wall so that the finger F can be inserted easily behind the main portion 13*a*, as shown in FIG. 24, when the handle 13 is in the unlocked position shown in FIG. 18. In the recessed portion 11*c*, space 11*g* is a space for accommodating an auxiliary portion 13*b* at the other end of the handle 13 in the released position, as shown in FIG. 26. In the locked position shown in FIG. 22, the auxiliary portion 13*b* is protruding upward 11*k* of the recessed portion but is surrounded by the side wall 11*a* of the frame 11. If it is specifically necessary, a portion 11*b* of the upper edge of the side wall may be formed in protruding fashion to correspond with the protruding amount of the auxiliary portion 13*b*, as shown in FIGS. 18 and 22, or a cover with a hole just sufficient to allow the insertion of a finger may be provided over the auxiliary portion 13*b*.

In this way, when the handle 13 is in the locked position shown in FIG. 22, if the passenger's body touches the auxiliary portion 13*b*, the handle 13 is prevented from being returned to the condition shown in FIG. 18. Further, the position of the fulcrum 14 of the handle 13 can be so selected as to make the main portion 13*a* longer than the auxiliary portion 13*b*, for example, in the proportion of 2:1, so that a larger operating force can be applied to the main portion 13*a* while making the force required to depress the auxiliary portion 13*b* large enough to prevent a child from tampering with it. Even with the pressing force of an adult's finger, the handle 13 can only be moved from the locked position to the unlocked position but cannot be pressed further inside.

If necessary, the construction should be designed so that the auxiliary portion 13*b* cannot be pushed with a finger deeper beyond the position of FIG. 18. That is, the wall width W below the space 11*g* should be made smaller than the width of a finger, as indicated by a two-dot chain line 11*m* in FIG. 20. In this case, the other end 13*b* of the handle should be formed relatively narrow as indicated by a two-dot chain line 13*g* in FIG. 17.

In the above construction, the operation between the positions shown in FIGS. 18, 22, and 26 accomplishes the same functions as those described with reference to FIGS. 3, 4, and 5. Further, when the handle 13 is in the unlocked position shown in FIG. 18, if the main portion 13*a* is pressed in a direction of arrow, that is, in the pressing direction, the handle 13 is put in the condition shown in FIG. 22; in that condition, the main portion 13*a* is accommodated in the enclosed position so that the main portion 13*a* cannot be held or pulled with a finger. However, since the auxiliary portion 13*b* at the other end is now located in the protruding position 11*k* where it can be pressed, when the auxiliary portion 13*b* is operated by an adult's finger in the direction of arrow in FIG. 22, i.e., in the pressing direction toward the recessed portion 11*g*, the main portion 13*a* returns to the unlocked position shown in FIG. 18. Here, if it is desired to move the handle 13 to the released position, since the handle 13 is now in the open position 11*f* with no obstructions around it, the main portion 13*a* can be pulled upward by holding it with the finger F as shown in FIG. 24. The handle 13 is now in the released position as shown in FIGS. 26 and 25. In this way, by moving one handle 13 between the three positions, unlocked position, locked position, and released position, the lock device main unit B can be switched between the closed position holding condition, locked condition, and released condition, as previously described. In this construction also, the handle operation is made different among the three modes; that is, moving from the unlocked position to the locked position is accomplished by pushing the main portion 13*a*, moving from the locked position to the unlocked position is accomplished by pushing the auxiliary portion 13*b*, and moving from the unlocked position to the released position, which requires a large force, is accomplished by pulling the main portion 13*a*.

POTENTIAL FOR EXPLOITATION IN INDUSTRY

As described above, according to the present invention, since the operating member 4 made switchable between the unlocked position U, locked position L, and released position R is interlocked with the engaging member 3 and switching means 6, the effect is that switching between the three modes, i.e, the closed position holding condition, locked condition, and released condition, can be performed simply by operating the operating member 4. This means that by connecting the operating member 4 with the operating handle by a single cable, for example, the prevention of theft, the safety in the event of a collision, and the facilitation of assembling to the door can be enhanced; furthermore, in the construction using a cable, since only one cable suffices, the construction can be implemented at a relatively low cost.

Moreover, in the construction achieving the above three mode operations using a single cable, provisions are made so that when the operating member 4 is moved from the unlocked position U to the released position R to effect release from the unlocked condition, the movement is transmitted to the engaging member 3 but is prevented from being transmitted to the switching means 6 by the presence of the releasing portion 64, which means that moving the operating member 4 only requires a force just sufficient to disengage the engaging member 3 from the latch member 2; this has the effect of being able to accomplish the releasing operation from the unlocked condition with a relatively small operating force.

Further, the operating member 4 and the switching member 6 are constructed so that, when the operating member 4 moves between the unlocked position U and the locked position L, the guide portion 63 provided on the operating member 4 pushes and moves the interlocking member 91 provided on the switching means 6 and thereby switches the switching means 6 between the unlocked condition and the locked condition; this has the effect of ensuring reliable switching of the switching means 6, without using a spring as in the prior art, even when the switching means 6 becomes difficult to move because of freezing or rusting.

Furthermore, according to the present invention, provisions are made so that in the unlocked and released positions, one end of the handle 13 which serves as the main portion 13*a* is located in the open position 11*f* in the frame 11 with no obstructions around it, enabling the passenger to operate it with his finger, and in the locked position, the main portion 13*a* is accommodated in the enclosed position 11*d* located in the deeper portion of the frame 11 and closed in on all sides to make it difficult for the passenger to operate it with his finger, while the other end 13*b* of the handle 13, in the locked position, is protruding near the frame's front edge 11*a* and is located in a position 11*k* where the passenger can push it down with his finger; the resulting feature is that in the locked position the main portion 13*a* of the handle is closed in on all sides so that to operate it, the auxiliary portion 13*b* on the other end must be pushed down. Accordingly, in the construction controlling the three modes using one handle, the effect is that the switching from the locked position to the unlocked position and from the unlocked position to the released position can be prevented from being accomplished by one continuous operation; this serves to prevent an accident as could be encountered in the prior art construction.

What is claimed is:

1. In a door lock device:

(a) a base frame having an engaging portion for engaging a striker;

(b) a rotatable latch member mounted on said base frame;

(c) an engaging member mounted on said base frame for engaging said latch member; and (d) a cable;

(e) an operating member mounted on said base frame and linked with an operating part by said cable, said operating member being switchable among three positions, an unlocked position, a locked position and a released position, by movement of said cable to place said engaging member selectably in one of an unlocked condition, a locked condition and a released condition, respectively;

(f) said operating member being interlocked with said engaging member so that when said operating member is in the released position, said latch member is disengaged from said engaging member, and when said operating member is in any of the other said positions, said latch member is engaged with said engaging member;

the improvement in said door lock device comprising;

(g) a switching member activated solely by an operation handle;

(h) said operating member and said engaging member being in interlocking relationship and providing said switching member with movement back and forth between the unlocked position facing a portion of said engaging member and the locked position for maintaining the locked condition of the engaging member;

(i) said switching member having a pin for interlocking with said operating member, said operating member having a guide portion for switching the pin between the unlocked position and the locked position by moving said pin when said operating member moves between the unlocked position and the locked position, and a releasing portion to terminate said interlocking with said pin when said operating member moves between the unlocked position and the released position, said guide portion of said operating member being formed as an elongated groove having a side juide face formed on each side thereof, said elongated groove being disposed in an oblique direction that crosses an arc having a radius with its center at a center of rotation of said operating member whereby, when said operating member is rotated, said pin being provided on the switching member is moved along each of said two guide faces alternately to switch the pin between the unlocked position and the locked position.

2. In a door lock device comprising:

(a) a rotatable latch member mounted on a base frame, said rotatable latch member having an engaging portion for engaging a striker;

(b) an engaging member mounted on said base frame for engaging said latch member;

(c) a cable; and (d) an operating member mounted on said base frame and linked with an operating part by said cable, said operating member being switchable selectably among three positions, an unlocked position, a locked position and a released position, by movement of said cable to place said engaging member in either an unlocked condition, a locked condition or a released condition, respectively;

(e) said operating member being interlocked with said engaging member so that when said operating member is in the released position, said latch member is disengaged from said engaging member, and when said operating member is in any of the other said positions, said latch member is engaged with said engaging member;

the improvement in said door lock device comprising:

(f) said operating part comprises a frame having a recessed portion for mounting on a door and a handle pivotably mounted with an intermediate point thereof pivoted in said recessed portion of said frame, in the unlocked position and the released position, one end of said handle being located in an open position in said frame with no obstructions around it to enable a passenger to operate a first end of the handle with a first finger, and, in the locked-position, said handle being accommodated in an enclosed position located in a deeper portion of said frame enclosed to make it difficult for the passenger to operate the handle with a finger, while said handle, is in the locked position, and protrudes from said frame in a position where the passenger can push a second other end of said handle with another finger.

3. A door lock device as claimed in claim 2 in which said handle has an upper face, a portion surrounding said upper face of said handle being formed far apart from the locked position to the unlocked position so that the handle can be pushed with a finger, and being formed relatively close to the unlocked position and to the released position.

* * * * *